US005740666A

United States Patent [19]

Yamaguchi et al.

[11] Patent Number: 5,740,666

[45] Date of Patent: Apr. 21, 1998

[54] METHOD AND SYSTEM FOR CONTROLLING THE ROTATIONAL SPEED OF A ROTARY RING MEMBER

[76] Inventors: Hiroshi Yamaguchi, 7-45, Ooyamada 6-chome, Kuwana-shi, Mie, 511; Masashi Yamaguchi, 12-7, Shimizuoka 1-chome, Sumiyoshi-ku, Osaka-shi, Osaka, 558, both of Japan

[21] Appl. No.: 587,241

[22] Filed: Jan. 16, 1996

Related U.S. Application Data

[63] Continuation-in-part of Ser. No. 237,362, May 3, 1994, abandoned, which is a continuation-in-part of Ser. No. 22,426, Feb. 16, 1993, abandoned, which is a continuation of Ser. No. 671,798, Aug. 3, 1990, abandoned.

[30] Foreign Application Priority Data

Aug. 3, 1989 [JP] Japan ..... 1-202129

[51] Int. Cl.[6] ..... D01H 7/46; D01H 7/92

[52] U.S. Cl. ..... 57/264; 57/75; 57/98; 57/100; 57/124

[58] Field of Search ..... 57/75, 98, 100, 57/124, 264

[56] References Cited

U.S. PATENT DOCUMENTS

| | | | |
|---|---|---|---|
| 2,932,152 | 4/1960 | Jackson | 57/124 |
| 3,693,340 | 9/1972 | Kanai et al. | 57/93 |
| 3,785,140 | 1/1974 | Muller | 57/124 |
| 3,851,448 | 12/1974 | Sano et al. | 57/124 |
| 3,950,927 | 4/1976 | Kallman | 57/264 |
| 4,023,342 | 5/1977 | Schenkel | 57/75 |

(List continued on next page.)

FOREIGN PATENT DOCUMENTS

| | | |
|---|---|---|
| 54-13528 | 5/1979 | Japan . |
| 54-15934 | 6/1979 | Japan . |
| 56-68119 | 6/1981 | Japan . |
| 61-152835 | 7/1986 | Japan . |
| 62-206036 | 9/1987 | Japan . |
| 62-263331 | 11/1987 | Japan . |
| 1168923 | 7/1989 | Japan . |
| 274633 | 3/1990 | Japan . |
| 2229227 | 9/1990 | Japan . |

OTHER PUBLICATIONS

Nistico et al, *The Textile Research Journal*, "A High-Speed Recording Yarn Tensiometer," pp. 99–110 (Feb. 1952).

"Fuzzy Control and Fuzzy Systems", by W. Pedrycz, Second, Extended, Edition, 1993, published by John Wiley & Sons Inc.

"Method for Calculation in Electronic Circuit", published by Nippon Riko Shuppan Kai, Dec. 5, 1983, paragraph 11.4 on pp. 198 and 199.

*Primary Examiner*—William Stryjewski

*Attorney, Agent, or Firm*—Watson Cole Stevens Davis, P.L.L.C.

[57] ABSTRACT

The present invention provides a unique method and system for automatically controlling the motion of a rotary ring twisting and winding device, provided with a rotary ring member rotatably mounted on a holder by way of a bearing mechanism, which is utilized for textile machines having a so-called ring traveller twisting and winding mechanism. The present invention is characterized in that the rotational speeds of the rotary ring member and spindles are continuously detected, and the detected rotational speed of the rotary ring member is compared with the desired rotational speed of the rotary ring member which is calculated by multiplying a predetermined ratio by the detected rotational speed of the spindles, and if it is detected that the rotational speed of the rotary ring member is out of control, the rotational speed of the rotary ring member is electrically controlled to return to a condition of satisfying a predetermined allowable controlled condition. The present invention is preferably applied to two types of rotary ring twisting and winding devices, one of which is provided with a magnetic bearing as the above-mentioned bearing mechanism, while the other one is a device provided with a ring motor for positively rotating the rotary ring member.

12 Claims, 6 Drawing Sheets

U.S. PATENT DOCUMENTS

| | | | |
|---|---|---|---|
| 4,095,402 | 6/1978 | Yamaguchi | 57/124 |
| 4,114,359 | 9/1978 | Creus | 57/124 |
| 4,270,340 | 6/1981 | Baucom et al. | 57/124 |
| 4,316,357 | 2/1982 | Le Chatelier | 57/98 |
| 4,319,450 | 3/1982 | Igel | 57/75 |
| 4,343,145 | 8/1982 | Barro | 57/124 |
| 4,359,858 | 11/1982 | Wolf | 57/93 |
| 4,548,028 | 10/1985 | Rebske et al. | 57/75 |
| 4,596,114 | 6/1986 | Donnelly | 57/75 |
| 4,817,371 | 4/1989 | Wolf | 57/100 |
| 5,009,063 | 4/1991 | Yamaguchi et al. | 57/75 |
| 5,010,722 | 4/1991 | Yamaguchi et al. | 57/100 |
| 5,115,632 | 5/1992 | Ulmer | 57/264 |

ROTATIONAL SPEED OF RING TO ROTATIONAL SPEED OF SPINDLE (S.P. x R.P.M.)
Sh x0.6~0.5
Sh x 1/2
Sh x0.5~0.4
S x 0.4~0.3
H.S.
FB
H.R.
0.95FB
0.8~0.9FB
0.5~0.55FB
0.4~0.5FB
0.22~0.3FB
0.1~ 0.2FB
0.05~0.1FB
TIME (SIZE RATIO)
TOTAL SPINNING TIME
TIME REQUIRED TO STOP MACHINE
SP CURVE
RP CURVE(1)
RP CURVE(2)
ROTATIONAL SPEED OF ROTARY RING MEMBER
COMMON ROTATIONAL SPEED OF SPINDLES
x10^3

METHOD AND SYSTEM FOR CONTROLLING THE ROTATIONAL SPEED OF A ROTARY RING MEMBER

This application is a Continuation-in-Part Application of U.S. patent application Ser. No. 08/237,362 filed May 3, 1994, which is a continuation-in-Part application Ser. No. 08/022,426 filed Feb. 16, 1993, which is a Continuation Application of U.S. patent application Ser. No. 07/671,798, filed Aug. 3, 1990, these three applications now abandoned, the disclosures of which are hereby incorporated by reference.

BACKGROUND OF THE INVENTION

1. Field of the invention

The present invention relates to a method and system for controlling the rotational speed of a rotary ring member of a rotary ring twisting and winding device particularly, a method and system for controlling the rotational speed of a rotary ring member of a rotary ring twisting and winding device provided with a magnetic bearing rotatably supporting the rotary ring member, applied to a textile machine wherein a plurality of rotary ring twisting and winding devices are utilized. The rotary ring twisting and winding device is hereinafter referred to as a rotary ring device to simplify the explanation of the present invention.

In this specification, the above-mentioned textile machine includes textile machines provided with a ring traveller twisting and winding mechanism, a ring spinning frame ring twisting machine, a draw twister utilized for producing synthetic fibers, a twisting machine for producing cover yarn, etc. The yarn material processed by such a textile machine includes all types of textile materials for producing yarn such as natural fibers, man-made fibers, etc.

2. Description of the Related Art

In the traditional twisting and winding device utilized for a textile machine such as a ring spinning frame or a ring twisting machine, a plurality of rings are stationarily mounted on a ring rail. On the other hand, it is well known in the art that, in a textile machine provided with a plurality of rotary ring devices, each rotary ring device is provided with a rotary ring member which is rotatably supported by a holder rigidly mounted on a ring rail by way of a bearing mechanism coaxially to a corresponding spindle so as to stably carry out the twisting and winding operation, for remarkably increasing the rotational speed of the spindles with a high level of production efficiency of the textile machine.

Regarding the bearing mechanism for rotatably supporting the rotary ring member by the holder, several technical ideas have been proposed. For example, Japanese Examined Patent Publication (Kokoku) No. 54-15934 discloses a slide bearing mechanism provided with an annular sliding surface; Japanese Examined Patent Publication (Kokoku) No. 54-13528 discloses a pneumatic bearing mechanism utilizing compressed air ejected into the bearing; and Japanese Unexamined Patent Publication (Kokai) No. 56-68119 discloses a ball-bearing mechanism.

However, in practice, it was found that these bearing mechanisms have several serious problems. One of these problems is synchronous rotation of the rotary ring member against the traveller. That is, the rotational speed of the traveller about the spindle axis is increased according to the increase of the spindle speed, and the rotational speed of the rotary ring member is increased according to the increase of traveller; thus the rotation of the rotary ring member may become synchronized to the rotation of the traveller, if no braking force is applied to inhibit the rotation of the rotary ring member. Accordingly, if the rotation of the rotary ring member is synchronized to the rotation of the traveller, the balance between the running of the traveller and the yarn tension is lost so that uniform twisting and winding operation cannot be continuously carried out.

On the other hand, another problem due to the inertia of the rotary ring member has been recognized. That is, since the winding diameter of a cop is largely changed during the formation of each chase of the cop, even through the rotational speed of the spindles during formation of each chase of the cop does not change, the rotational speed of the traveller about the spindle axis is changed so that a uniform winding tension can be maintained. However, the inertia of the rotary ring member prevents timely changing of the rotational speed of the rotary ring member, which should follow the changing condition of the rotational speed of the traveller, so that the balance between the rotational speed of the traveller and that of the rotary ring member is lost. Such a phenomenon creates an unusually large variation in the spinning tension. This condition worsens if the rotation speed of the spindles is higher.

Another serious problem occurs at the completion of the formation of a full packaged cop. That is, when the cop becomes substantially full packaged, a drive motor of the spindle is switched off. If no braking action is applied to inhibit the rotation of the rotary ring member, the inertia of the rotary ring member prevents timely slowing down of the rotational speed of the rotary ring member so as to stop the rotation thereof no later than when the rotation of the spindles has completely stopped, so that the creation of snarls cannot be prevented, because of the over-running of the rotary ring member on the corresponding spindle.

To solve the above problems, for example, it has been proposed that, when the size of a cop reaches an almost a full packaged condition, the rotational speed of the spindles is stepwisely reduced so that the rotational speed of the traveller, which is running on the annular flange of the corresponding rotary ring member, is also reduced while maintaining the winding tension in an allowable condition. As a result, the rotational speed of the rotary ring member follows the reduction of the rotational speed of the traveller. However, it was confirmed that such a stepwise reduction of the rotational speed of the spindles cannot solve the above problems, such as creation of snarls, when the driving of the spindles is stopped.

As another method for solving the above problems associated with stopping the rotation of the spindles, it has been proposed that a friction force applied to the rotary ring member be created by grasping the respective rotary ring members upon stopping of the rotation of all spindles of the spinning frame, and thereby a braking action is simultaneously applied to all rotary ring devices (Japanese Unexamined Patent Publication (Kokai) No. 62-206036). Another braking mechanism utilizing an oil pressure or the like has been proposed (Japanese Unexamined Patent Publication (Kokai) No. 62-26331), however, such braking mechanisms are also simultaneously applied to all rotary ring devices. However, such proposals disclose simultaneous control action applied to all rotary ring devices of the textile machine, and do not teach any technical idea applied to the rotary ring devices separately. Accordingly, it is impossible to solve the problem that the variation of the rotational speed of the rotary ring members is large so that undesirable variation of yarn quality is created.

From the above technical point of view, the applicant of the present invention has proposed several technical ideas, as disclosed in Japanese Unexamined Patent Publication (Kokai) No. 2-74633; and Japanese Patent Application No. 2-229227 filed under convention priority based upon Japanese Patent Application No. 63-282854. However, it was found that even if the above-mentioned technical idea is adopted, it is difficult to produce high quality yarn, if the rotational speed of the spindles is greatly increased so as to guarantee high production efficiency.

SUMMARY OF THE INVENTION

As mentioned above, the rotary ring device has been introduced into the textile industry, however, the application of the rotary ring device in the textile industry has not been expanded, in spite of the impressive function of the rotary ring device. It can be interpreted that a drawback preventing the possible expansion of the use of the rotary ring device in the textile industry is the discrepancy between the high rotational speed of the spindles and the spinning condition.

It is a principal object of the present invention to provide an automatic method and system for controlling the rotational speed of the rotary ring member of the rotary ring device provided with a magnetic bearing rotatably supporting the rotary ring member so as to carry out the operation with high productivity while maintaining the most desirable operating conditions.

It is well known that operating conditions are different due to the difference in the kinds of yarn, (material, yarn counts, etc.), kind of rotary ring device, rotational speed of spindles, kind of textile machines utilizing the rotary ring device, etc. Under these conditions, the applicants of the present invention noted the fact that the tension of the yarn in the production operation by the rotary ring device (hereinafter referred to as a spinning yarn tension or yarn tension, briefly) can be used as a measure to indicate the operational condition. Accordingly, it is an object of the present invention to provide an automatic method and system for controlling the rotational speed of the rotary ring member which is the main element of the rotary ring device, by which the rotational speed of the spindles can be increased to the possible highest rotational speed under a condition that the yarn tension is always maintained in an allowable condition, while the period for driving the spindle at its highest speed can be maintained as long as possible.

To attain this object of the present invention, it is essential that the rotational speed of the rotary ring member can be electrically controlled. In the present invention, a key point is in controlling the rotational speed of the rotary ring member in order to increase the production efficiency so as to provide the best operating condition. From this point of view, in the present invention, the rotational speed of the rotary member is controlled in such a manner that the yarn tension, which is a measure of the operating condition, is always maintained in an allowable range. In the design of a program for controlling the rotational speed of the spindles, it is also considered that the period in which the rotational speed of the spindle is maintained at its highest speed is made as long as possible, so that the production capacity of the textile machine can be remarkably increased. Accordingly, in the present invention, the rotational speed of the rotary ring member is controlled in direct relation to the rotational speed of the spindles with a common measure being "yarn tension".

According to the above-mentioned basic technical idea, in the present invention, firstly, the control program for changing the rotational speed of the spindles over an entire period for producing a full packaged cop by each rotary ring device of a textile machine is designed so as to maintain the yarn tension in its allowable range, while considering the control effect of the rotational speed of the rotary ring member on the yarn tension. Secondly, the ratio of the rotational speed of the rotary ring member to the rotational speed of the spindles is set in the above-mentioned entire period for carrying out the full packaged cop forming operation. Accordingly, a program for setting the above-mentioned ratio in relation to the above-mentioned control program for changing the rotational speed of the spindles, is created, and as a result, the program for setting the ratio (rotational speed of the rotary ring member/rotational speed of spindles) is created. In the program for setting the above-mentioned ratio, the ratio indicates the relation between the rotational speeds of the rotary ring member and the spindles at an identical time point during the full packaged cop forming process.

In the above explanation, the rotational speed of the spindles means the representative value of the rotational speeds of the respective spindles, in other words is, a common rotational speed of spindles, such as an average value of the rotational speeds of the respective spindles.

The above-mentioned program for controlling the common rotational speed of spindles and the ratio of the rotational speed of the rotary ring member to the common rotational speed of spindles, can be easily created by referring to data such as experimental data obtained by a preliminary experimental test. In creating the program for controlling the common rotational speed of spindles, the ratio between the rotational speed of the rotary ring member to the common rotational speed of spindles is set in consideration of the fact that the rotational speed of the rotary ring member should not be synchronized to the rotational speed of the corresponding traveller of an identical rotary ring device.

Next, the gist of an automatic control method for controlling the rotational speed of the rotary ring member according to the present invention is explained with reference to a typical example thereof.

In the typical example of the automatic control method for controlling the rotational speed of the rotary ring member according to the present invention, the rotational speed of the rotary ring member is first accelerated by increasing the rate thereof more slowly than the rate of increase of the common rotational speed of spindles, while maintaining the rotational speed thereof at a value lower than that of the common rotational speed of spindles, until the common rotational speed of spindles reaches its highest value. When the common rotational speed of spindles reaches its maximum value, which is remarkably higher than the maximum value of the common rotational speed of spindles adopted in the conventional mode of the full packaged cop forming process by the known rotary ring device, the rotational speed of the rotary ring member also reaches its highest value. In the period of carrying out the full packaged cop forming process at the maximum common rotational speed of spindles, wherein the production operation is carried out under the most stable condition of yarn tension, the rotational speed of the rotary ring member is controlled at its maximum value, or the rotational speed thereof is once reduced to a rotational speed at which the yarn tension can be maintained in its allowable range, and the rotational speed of the rotary ring member is maintained at the above-mentioned reduced speed, and the rotational speed thereof is again increased to its maximum value at a time just before the completion of the process to produce the full packaged cop, while the common rotational speed of spindles is still maintained at its highest value. And, in the period when the common rotational speed of spindles is reduced from its maximum value to a time right before the completion of the full packaged cop forming process, the rotational speed of the rotary ring member is also reduced from its maximum value, in such a manner that the rate of reducing the rotational speed of the rotary ring member is not smaller than the rate of reducing the common rotational speed of spindles, and the rotation of the rotary ring member is controlled so as to stop at a time not later than the time of complete stopping of the rotation of the spindles. In the design of the control program for controlling the common rotational speed of spindles, the entire period for carrying out the full packaged cop forming process is divided into several sub-periods, which are successively arranged as, for example, a first period for accelerating the common rotational speed of spindles until the common rotational speed of spindles reaches its maximum value, a second period in which the common rotational speed of spindles is maintained at its maximum value, while the yarn tension is maintained in its allowable range, a third period in which the common rotational speed of spindles is reduced from its maximum value and finally the rotation of the spindles is stopped. The above-mentioned first, second and third periods are further divided into continuously connected sub-periods which are dependent upon the cop forming steps, and the ratio of the rotational speed of the rotary ring member is set according to the common rotational speed of spindles in the above-mentioned periods or sub-periods, respectively, in such a way that the above-mentioned ratio is representative of each period or sub-period.

In the automatic method for controlling the rotational speed of the rotary ring member according to the present invention, the above-mentioned control program for controlling the common rotational speed of spindles and the control program for controlling the ratio (rotational speed of the rotary ring member/common rotational speed of spindles) are established in advance and stored in a memory means in the control system for carrying out the automatic method for controlling the rotational speed of the rotary ring member. In this control method, the rotational speed of the rotary zing member of each rotary ring device is continuously and separately detected, the common rotational speed of spindles, which is controlled in accordance with the above-mentioned control program, is also continuously detected, the desired rotational speed of the rotary ring member is calculated by multiplying the above-mentioned ratio obtained from the memorizing means by the detected common rotational speed of spindles at an identical time when detecting the rotational speed of the rotary ring member, and then the detected rotational speed of the rotary ring member is compared with the above-mentioned desired rotational speed of the rotary ring member. And, if this comparison detects that the rotational speed of the rotary ring member of a particular rotary ring device is out of control, the rotational speed of the rotary ring member of the particular rotary ring device is electrically controlled so as to return to its controlled condition.

In the present invention, besides the above-mentioned basic technical idea, the following modified method is also employed. That is, based upon the above-mentioned control method, the yarn tension is continuously detected to confirm whether the yarn tension is maintained in its allowable range, and if it is detected that the yarn tension is outside of the allowable range, even if the rotational speed of the rotary ring member is in the allowable range in relation to the common rotational speed of spindles, the rotational speed of the rotary ring member is electrically controlled so as to return the yarn tension into its allowable range.

The above-mentioned control method of the rotational speed of the rotary ring member is preferably applied to a textile machine, such as a spinning frame, twisting machine, draw twister, etc., utilizing the rotary ring device provided with a mechanism for electrically controlling the rotational speed of the rotary ring member and these textile machine are provided with a variable speed control means such as an inverter, sequential control device or the like, by which the common rotational speed of spindles is capable of being controlled together with other related mechanisms, such as a draft mechanism. It is an advantage that the production process of such textile machines can be carried out with high production efficiency under stable processing conditions in spite of the spindles being driven at a very high rotational speed as compared with textile machines without the rotary ring devices.

The above automatic control method for controlling the rotational speed of the rotary ring member is effectively applied to a rotary ring device provided with a bearing mechanism utilizing a magnetic bearing, and also, a rotary ring device provided with a rotary ring member rotatably supported by a holder rigidly mounted on a ring rail via a bearing mechanism, and having a ring motor constructed by an annular permanent magnet coaxially arranged in the rotary ring member with an annular shaped armature rigidly supported by the holder in a coaxial relationship to the annular permanent magnet.

In the case of applying the above-mentioned automatic control method for controlling the rotational speed of the rotary ring member to the first mentioned rotary ring device, since the magnetic bearing is preferably formed by a first annular magnet, which is a permanent magnet, secured to the outer cylindrical surface of the rotary ring member and a second annular magnet, which is formed by an electromagnet, secured to the inner cylindrical surface of the holder in such a way that the first annular magnet faces the second annular magnet so that a minute annular space can be formed during a period when the balance between the magnetic force of the first annular magnet and that of the second annular magnet in relation to the weight of the rotary ring member, is maintained. Accordingly, if the above-mentioned balance is lost, the outer surfaces of the above-mentioned first and second annular magnets are attracted to each other by displacing the rotary ring member along the axial direction of the spindle, and accordingly, a braking action is created by contacting the first annular magnet with the second annular magnet, so that braking force can be applied to the rotation of the rotary ring member by controlling the electric current supplied to the second annular magnet.

On the other hand, in the case of utilizing the rotary ring device provided with the ring motor, to which the basic technical idea of the present invention can be applied, that is, the rotational speed of the rotary ring member can be effectively controlled by adjusting the electric current supplied to the armature of the ring motor, in such way that the frequency or magnitude or voltage used to supply the electric current is adjusted. Other than the above-mentioned adjustment of the rotational speed of the rotary ring member, the function of the control system applied to the rotary ring device provided with the ring motor is identical to that of the above-mentioned control system applied to the rotary ring device utilizing the magnetic bearing.

Accordingly, the following automatic system for controlling the rotational speed of the rotary ring member of the rotary ring device which is provided with means for regulating the rotational speed of the rotary ring member thereof, is adopted in the present invention. In this automatic control system, firstly, a control program is established for changing a common rotational speed of spindles S during the entire period for carrying out the full packaged cop forming process, in a manner so as to maintain the yarn tension within an allowable range, and for controlling a ratio ($\alpha$) of the rotational speed (R) of the rotary ring member to the common rotational speed of spindles (S) at an identical time point in relation to the above-mentioned program for controlling the common rotational speed of spindles S. The above-mentioned control system is provided with means for memorizing the above-mentioned control program for controlling the common rotational speed of spindles S and a program for controlling the above-mentioned ratio ($\alpha$) which is consequently made in relation to the control program for controlling the common rotational speed of spindles S; means for continuously detecting the common rotational speed of spindles S; means for continuously detecting a rotational speed R of the rotary ring member of each rotary ring device independently; means for calculating a desired rotational speed Rj of the rotary ring member of each rotary ring device by the following formula, $S \times \alpha$, where S is the detected data of the common rotational speed of spindles at a time identical to the time of detecting the above-mentioned data R, $\alpha$ is a data from the above-mentioned memory means, which corresponds to the above-mentioned time of detecting the data R and S; means for comparing the above-mentioned two data R and Rj; and means for electrically controlling other means for regulating the rotational speed of the rotary ring member of a particular rotary ring device, when it is detected that the detected rotational speed R is out of control, or when the comparing means detects that the rotational speed R of the particular rotary ring member is out of control, whereby the rotational speed of the rotary ring member of the particular rotary ring device is electrically controlled by the above electric control means so that the rotational speed of the rotary ring member concerned is returned to the controlled condition, that is, in the case of rotary ring device provided with a magnetic bearing, the braking force for regulating the rotational speed of the rotary ring member is controlled by controlling the electric current supplied to the electric magnet of the magnetic bearing, while in the case of the rotary ring device utilizing a ring motor, the rotational speed of the rotor thereof is controlled by controlling the electric current supplied to the armature thereof. In the above-mentioned control system, means for continuously detecting common rotational speed of spindles S of the spindle comprises element means for continuously detecting a rotational speed $S_0$ of the plurality of spindles and calculating an average value of the above-mentioned instant data $S_0$ as a representative measure of "common rotational speed of spindles S". In the above-mentioned automatic control system, the component elements thereof, except for the means for detecting the rotational speed $S_0$ of the spindles and means for detecting the rotational speed of the rotary ring member, are preferably assembled as a central control device.

Further, the automatic control method and system for controlling the rotational speed of the rotary ring member according to the present invention can be applied to other types of rotary ring devices provided with a function that the rotational speed of the rotary ring member can be electrically controlled by an electric signal issued from outside of the rotary ring device as in the above two types of rotary ring devices.

DESCRIPTION OF THE PREFERRED EMBODIMENTS

CONTROL PROGRAM FOR CONTROLLING THE ROTATIONAL SPEED OF SPINDLES

Figure 1:
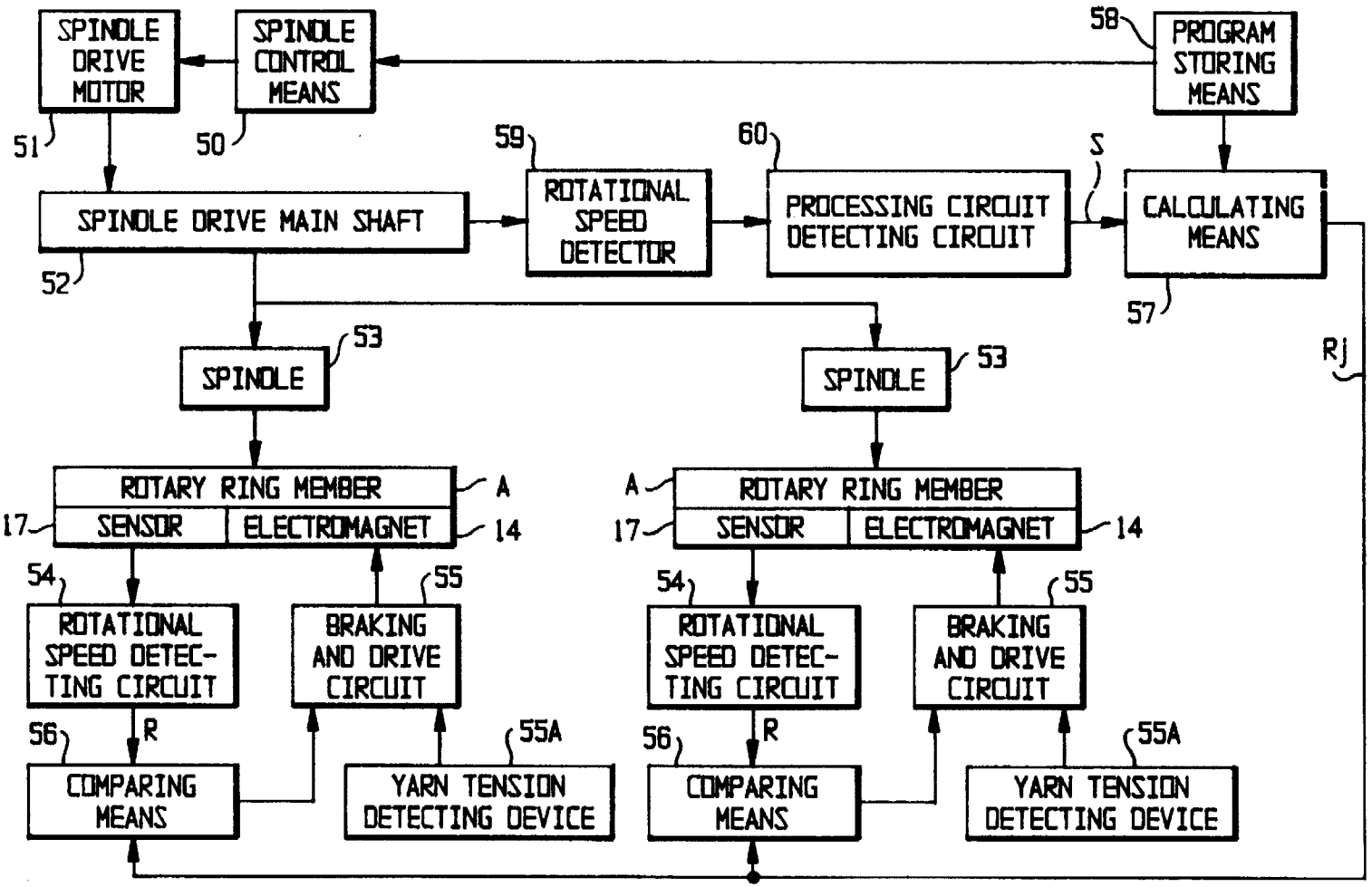
FIG. 1 is a block diagram of an automatic control method for controlling the rotational speed of the rotary ring member according to the present invention, wherein two spindles are indicated as a control subject.

It is well known in the art that, in each ring-traveller twisting and winding device of a ring spinning frame, a bundle of fibers delivered from a pair of front rollers is twisted by running a traveller guided by a ring about a spindle, and then wound on a bobbin mounted on the spindles, after passing through the traveller in such a condition that the traveller is running on an annular flange of the ring in a direction identical to the rotating direction of the spindle by the action of the spinning tension of the twisted bundle of fibers, that is, a twisted yarn. In the above-mentioned running motion of the traveller, the speed of the traveller about the spindle is a little lower than the winding speed of the yarn on the bobbin which is defined by the rotational speed of the spindle and the diameter of the yarn layer on the bobbin. The above-mentioned phenomenon is identical in the case of utilizing the rotary ring device, except for the difference due to the fact that the rotary ring member is rotated about the corresponding spindle.

In the case of the rotary ring device, the running traveller provides a pulling force, which is created by its running under spinning tension, to the rotary ring member, as a result of the above-mentioned action of the traveller in relation to the rotary ring member, and accordingly, the rotary ring member is forced to rotate about the spindle. Therefore, if no braking force is applied to the rotary ring member, if the common rotational speed of spindles S is elevated, the spinning tension is also elevated so that the rotational speed of the traveller is elevated while maintaining the above-mentioned relation therebetween. Accordingly the above-mentioned pulling force of the traveller is increased so that the rotational speed of the rotary ring member is elevated, and finally the rotation of the rotary ring member becomes synchronized to the rotational speed of the traveller about the spindle. It is well known in the art, that since the winding speed of the twisted yarn on the bobbin mounted on the spindle should be maintained at a constant speed during the winding operation to create each chase to the cop, even if the diameter of the yarn layer on the cop is changed between the diameter of the bobbin and the maximum diameter in the chase, therefore, the rotational speed of the traveller about the spindle axis is changed in a condition corresponding to the change of diameter of a yarn layer formed on the bobbin during each chase formation. Since the maximum diameter of the yarn layer in the chase is identical to the maximum diameter of the full packaged cop and the minimum diameter thereof is identical to the thickness of the bobbin, the rotational speed of traveller is changed between two speeds corresponding to the maximum diameter and minimum diameter of the yarn layer of each chase so as to maintain the balance between the rotational speed of the traveller and the winding speed of the twisted yarn on the bobbin during the formation of each chase. In other words, when the winding diameter is increasing while the ring rail, wherein the rotary ring device is mounted, is displaced downward during each chase formation, the rotational speed of the traveller increases to follow an increase in the winding diameter on the bobbin. On the other hand, if the winding diameter is decreasing while the ring rail is displaced upwards during each chase formation, the rotational speed of the traveller is lowered to follow the decrease in the winding diameter. However, such a prompt change of the rotational speed of the rotary ring member cannot be achieved in the conventional rotary ring device, because the inertia of the rotary ring member prevents a rapid change in the rotational speed of the rotary ring member. Therefore, a problem is created in that when the rotational speed of the traveller is decreasing in accordance with a decrease in the winding diameter of yarn on the bobbin during the formation of each chase, particularly when the rotational speed of the rotary ring member is very close to that of the traveller, because the rotational speed of the rotary ring member cannot exactly follow the decreasing rotational speed of the traveller, and there is a strong possibility that the rotational speed of the rotary ring member may go over the rotational speed of the traveller, accordingly, the spinning tension would exceed its allowable range. This problem becomes more serious when the spindles are driven at a very high speed such as 30,000 rpm. If the above-mentioned unbalanced condition between the rotational speed of the traveller and that of the rotary ring member is created, the yarn passing through the traveller is subject to repeated stress which causes the creation of fiber-abrasion so that nappy yarn, melted yarn (in the case of producing thermo plastic fiber yarn), weak yarn, etc., is created, in addition to frequent breaks in the processing of the yarn.

Another serious problem occurs at the time of stopping the rotation of the spindles when the formation of the full packaged cop is completed, that is, after switching off the driving of spindles, the spindles are continuously rotated while reducing the rotational speed thereof, because of the inertia of the driving mechanism including the spindles. On the other hand, the rotational speed of the traveller is also reducing in accordance with the lowering of the common rotational speed of spindles. However, if no braking action is applied to inhibit the rotation of the rotary ring member, there is a strong possibility that the rotary ring member will stop some time after the spindles are stopped, because of the inertia of the rotary ring member, so that snarl is created.

Generally speaking, it is well known in the art that the production efficiency of the rotary ring device is increased if the common rotational speed of spindles is increased, like the conventional ring traveller twisting and winding device. However, as already explained, the discrepancy between the advantage expected by increasing the common rotational speed of spindles and the disadvantage based upon the damage to the spinning condition such as yarn tension prevents the possible wide use of the rotary ring device. The invention of the present application was conceived based on the following technical idea, that is; since the yarn tension can be used as a measure to indicate the spinning condition, if the yarn tension is maintained in its allowable range by controlling the rotational speed of the rotary ring member of the rotary ring device, the common rotational speed of spindles of the rotary ring device can be increased as high as possible. The present invention was developed based upon the above-mentioned technical idea. Accordingly, in the present invention, the control program for changing the common rotational speed of spindles (S) in the entire period of the full packaged cop forming process is based on a basic condition that the yarn tension is maintained in its allowable controlled condition, that is, in an allowable range thereof, in consideration of the advantage due to the automatic control of the rotational speed (R) of the rotary ring member so as to maintain the yarn tension in its allowable range, whereby the common rotational speed of spindles (S) is increased as high as possible, while the period of yarn producing operation carried out under the maximum common rotational speed of spindles is expanded as long as possible. On the other hand, the rotational speed of the rotary ring member is controlled by a measure, which is a ratio of the rotational speed (R) of the rotary ring member of the rotary ring device to the spindle (S), so that the control program of ($\alpha$) is established in relation to the above-mentioned control program for controlling the common rotational speed of spindles (S). Consequently, the basic technical idea of the automatic control method and the system for controlling the rotational speed of the rotary ring member is that the rotational speed of the rotary ring member is controlled according to the above-mentioned control program for controlling the ratio ($\alpha$) while maintaining the yarn tension in its allowable range.

For better understanding of the present invention, the control programs for controlling the common rotational speed of the spindles and the rotational speed of the rotary ring member and for carrying out the automatic method for controlling the rotary ring member, which is hereinafter identified by the word "basic", if necessary in the following explanation of the present invention, are explained regarding the case of producing a standard cotton yarn of medium count between 40°–60°, by a high speed ring spinning frame which is driven at a maximum common rotational speed of spindle of 30,000 rpm.

(1) Initial stage of increasing common rotational speed of spindles a: First acceleration zone (line $N_1$)

After starting the rotation of spindles for producing full packaged cops, the common rotational speed of spindles S is accelerated at a constant acceleration rate until the common rotational speed of spindles S reaches a first step speed $S_1$ (normally 10,000 rpm–12,000 rpm). The common rotational speed of spindles S reaches the first step speed $S_1$ after a time period $P_1$ (normally 5 sec–10 sec) from the starting point.

b: Second acceleration zone (line $N_2$)

After the common rotational speed of spindles S reaches the first step speed $S_1$, the common rotational speed of spindles S is accelerated at a constant acceleration rate until the common rotational speed of spindles S reaches a second step speed $S_2$ (normally 15,000 rpm). The common rotational speed of spindles S reaches the second step speed $S_2$ after a time period $P_2$ (normally 20 sec–30 sec) after the starting point.

c: Third acceleration zone (line $N_3$)

After the common rotational speed of spindles S reaches the second step speed $S_2$, the common rotational speed of spindles S is further accelerated at a constant acceleration rate, and the common rotational speed of spindles S reaches a third step speed $S_3$ (normally 18,000 rpm), within 60 seconds after starting the rotation of the spindles.

d: Fourth acceleration zone (line $N_4$)

After the common rotational speed of spindles S reaches the third step speed $S_3$ the common rotational speed of spindles S is further accelerated at a constant acceleration rate until the common rotational speed of spindles S reaches a fourth step speed $S_4$ (normally 20,000 rpm). By the time the common rotational speed of spindles S reaches the fourth step speed $S_4$, a cop having a size of 0.5% of a full packaged cop is completed, that is, the formation of the tail end portion of the full packaged cop is completed.

e: First constant speed zone (line $C_1$)

After the common rotational speed of spindles S reaches the fourth step speed $S_4$, the common rotational speed of spindles S is maintained at the speed $S_4$ until the size of the cop becomes 10% of the size of the full packaged cops.

f: Fifth acceleration zone (line $N_5$)

When the size of the cop becomes 10% of the size of full packaged cop, the common rotational speed of spindles S is accelerated at a constant acceleration rate, until the size of the cop becomes 20% of the full packaged cop where the common rotational speed of spindles S reaches a fifth step speed $S_5$ (normally 25,000 rpm).

g: Second constant speed zone (line $C_2$)

The common rotational speed of spindles S is maintained at the fifth step speed $S_5$ until the size of the cop reaches a size between 20% and 30% of the full packaged cop so that a bottom portion including the tail end portion of the full packaged cop is formed.

h: Sixth acceleration zone (line $N_6$)

Thereafter, the common rotational speed of spindles S is accelerated at a constant acceleration rate until the common rotational speed of spindles S reaches its maximum speed $S_h$ (30,000 rpm). The size of the cop becomes 40%–50% of the full packaged cop at this time point when the common rotational speed of spindles S reaches the speed $S_h$.

i: As indicated in the diagram shown in FIG. 3, the acceleration rate for increasing the common rotational speed of spindles S is gradually made smaller.

(2) Main stage of maximum common rotational speed of spindles $S_h$ (line $C_3$)

When the common rotational speed of spindles S reaches the maximum speed $S_h$ (e.g. 30,000 rpm), the formation of the bottom portion is completed, and the spinning condition becomes stable. This condition can be maintained until the size of the cop becomes substantially full packaged, i.e., approximately 95% of the full packaged cop. Accordingly, the common rotational speed of spindles S can be maintained at its maximum speed $S_h$ until the size of the cop becomes substantially that of a full packaged cop.

(3) A final stage of decelerating the common rotational speed of spindles a: First decelerating zone (line $N_7$)

When the size of the cop reaches a substantially full packaged condition, that is, 95% of the full packaged cop, the common rotational speed of spindles S is then decelerated at a constant deceleration rate so as to reduce to the seventh step speed $S_7$, which is one half of the maximum speed $S_h$, that is, 15,000 rpm. The seventh step speed $S_7$ is identical to the second step speed $S_2$.

b: Fourth constant speed zone (line $C_4$)

After the common rotational speed of spindles S reaches the seventh step speed $S_7$, the common rotational speed of spindles S is maintained at the seventh step speed $S_7$, until the driving of the spindles is switched off.

c: Second deceleration zone (line $N_8$)

Figure 3:
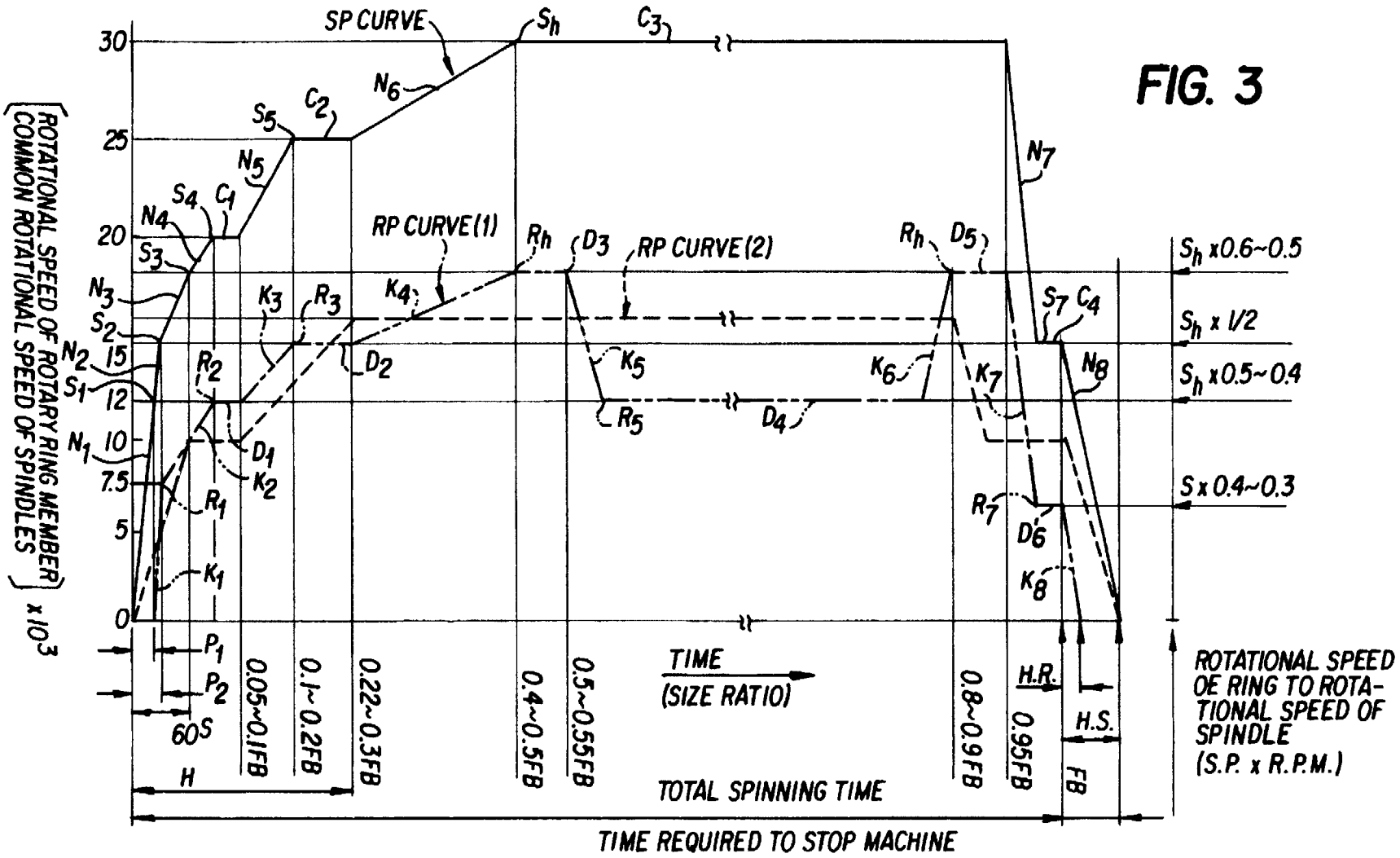
FIG. 3 is an explanatory view of a control program for controlling the rotational speed of the spindles, in relation to a control program for controlling the rotational speed of the rotary ring member from a starting time for forming a full packaged cop to a time of completion of the formation of the full packaged cop.

When the driving of the spindles is switched off, the spindles continue their rotation caused by the inertia of the driving mechanism including the spindles, and are finally stopped, after a short time indicated by HS in FIG. 3. As shown in FIG. 3, common rotational speed of spindles is reduced at a substantially constant rate along the line $N_8$. When the driving of the spindles is switched off, the ring rail is simultaneously displaced downward to its initial position, where the winding of the tail end of the yarn on the cop is carried out, so that the formation of a full packaged cop is completed.

As is clear from the above explanation of the basic control program for controlling the common rotational speed of spindles, the period from the time of starting the driving of spindles to the time when the common rotational speed of spindles S reaches its maximum speed, is remarkably shortened in comparison with the known operation mode of utilizing the conventional rotary ring devices, while the period for reducing the common rotational speed of spindles so as to create a safe condition to complete the full packaged cop forming process is positively shortened. Accordingly, the period for carrying out the full packaged forming process under the maximum common rotational speed of spindles, which can be set at a very high level, can be remarkably expanded. This is a distinct advantage of the present invention.

The above-mentioned design of the control program of the common rotational speed of spindles and the control program for controlling the ratio of the rotational speed of the rotary ring member to the common rotational speed of spindles, can be made with reference to basic data obtained by experimental tests with reference to the experience obtained from textile engineering in the past. However, after putting the initially designed programs into practice, the data obtained in the practice of the automatic control method of the present invention when used in production can be utilized to modify the programs used so that data accumulated based upon actual use becomes very valuable for modifying the control programs.

As already explained, the automatic control method for controlling the rotational speed of the rotary ring member according to the present invention is preferably applied to two types of rotary ring devices, that is, a rotary ring device utilizing a magnetic bearing and a rotary ring device utilizing a ring motor. The principles of the control methods applied to these two types of rotary ring devices are identical, however, the details of the methods thereof are a little different. That is, as already explained in the case of applying the present invention to a rotary ring device utilizing a magnetic bearing, the rotary ring is rotated by the pulling force created by the rotation of the traveller which is running thereon, therefore, the rotational speed of the rotary ring member is accelerated according to an increase in the rotational speed of the traveller which follows the common rotational speed of spindles, and the rotational speed of the rotary ring member approaches the maximum rotational speed of the traveller when the rotational speeds of the spindles and the traveller reach their maximum speeds, and ultimately, the rotation of the rotary ring member becomes synchronized to the rotation of the traveller. Accordingly, in the case of controlling the rotational speed of the rotary ring member of the rotary ring device utilizing a magnetic bearing, it is essential to control the rotational speed of the rotary ring member by applying braking action to the rotation of the rotary ring member. On the other hand, in the case of applying the present invention to a rotary ring device utilizing a ring motor, the rotational speed of the rotary ring member is positively controlled by adjusting the electric current supplied to the rotary ring motor without any physical relation to the rotation of the traveller. However, since it is a basic technical idea of the present invention to control the rotational speed of the rotary ring member that according to a control program in direct relation to the control program for controlling the common rotational speed of spindles in the period from the starting time of driving the spindles and the time point when the rotation of the spindles is completely stopped. Accordingly, before explaining the automatic control method for controlling the rotation of the rotary ring member of the present invention in detail, a typical control program for controlling the rotational speed of the rotary ring member is explained, in relation to a typical control program for controlling the common rotational speed of spindles, as follows:

BASIC CONTROL PROGRAM FOR CONTROLLING THE ROTATIONAL SPEED OF THE ROTARY RING MEMBER (Typical example)

(1) Starting the rotation of the rotary ring member

In order to create a condition wherein the tail end portion of the cop is stably formed under the most desirable spinning conditions, the applied braking action against the free rotation of the rotary ring member is released after a short period of e.g. between 5 and 10 sec from the time when the spindles are first driven. At the time when the above-mentioned braking action applied to the rotary ring member is released, the common rotational speed of spindles S reaches its first step speed S, (10,000 rpm–15,000 rpm). Since the traveller has been rotating on the annular flange of the rotary ring member, the rotary ring member instantly starts to rotate.

(2) Period for accelerating the rotational speed of the rotary ring member a: First acceleration zone (line $K_1$)

Until the common rotational speed of spindles S reaches its second step speed $S_2$ (15,000 rpm), that is, until the end of the period $P_2$ (60 second), the rotational speed R is controlled within a range between 50% and 60% of the common rotational speed of spindles S of the spindles with an acceleration rate higher than the acceleration rate of the common rotational speed of spindles S, and the rotational speed R is controlled so as to reach a first step speed $R_1$ (7,500 rpm) at the end of the period $P_2$, where the common rotational speed of spindles S reaches its 2nd step speed $S_2$ (15,000 rpm). However, the acceleration rate of the common rotational speed of spindles in this period $P_2$ is so high that a fairly strong shock is applied to the running traveller. Therefore, to moderate the shock applied to the traveller, the acceleration rate applied to the rotary ring member may be increased so as to increase the ratio of the rotational speed of the rotary ring member to the common rotational speed of spindles to a ratio between 80% and 90%.

b: Second acceleration zone (line $K_2$)

Thereafter, the rotational speed of the rotary ring member is further accelerated at a constant acceleration rate under control until the rotational speed thereof reaches a second step speed $R_2$ (almost 12,000 rpm), which is a ratio between 50% and 60%, to the fourth common rotational speed of spindles $S_4$.

The size of the cop becomes 5% of the size of a full packaged cop when the rotational speed R reaches the second step speed $R_2$.

c: First constant speed zone (line $D_1$)

When the rotational speed of the rotary ring member reaches the second speed $R_2$, the rotational speed R of the rotary ring member is maintained at the second step speed $R_2$, during the period that the common rotational speed of spindles S is maintained at the fourth step speed $S_4$, as indicated by the line $D_1$.

d: Third acceleration zone (line $K_3$)

When a formation of 10% of the size of a full packaged cop is completed, the rotational speed R of the rotary ring member is controlled so as to accelerate its speed at a constant rate, in relation to the acceleration of the common rotational speed of spindles S, until the common rotational speed of spindles S reaches the fifth step speed S (25,000 rpm), where the ratio R/S is a value between 50%–60%. The rotational speed R of the rotary ring member reaches the third step speed $R_3$ (15,000 rpm) at the end of this zone.

e: Second constant speed zone (line $D_2$)

During the period for forming a cop having a cop size between 22% and 30% of a full packaged cop, the rotational speed R of the rotary ring member is controlled so as to maintain the third step speed $R_3$ (15,000 rpm).

The formation of the bottom portion including the tail end portion of the full packaged cop is completed at the end of this zone.

f: Fourth acceleration zone (line $K_4$)

When the cop reaches 30% of the size of a full packaged cop, the rotational speed R of the rotary ring member is controlled to accelerate at a constant rate in accordance with the constant acceleration of the common rotational speed of spindles S in the sixth acceleration zone thereof, and the rotational speed R of the rotary ring member is controlled to reach its maximum speed $R_h$ (18,000 rpm) at the time when the common rotational speed of spindles S reaches its maximum speed $S_h$ (30,000 rpm). The ratio of the rotational speed R of the rotary ring member to the common rotational speed of spindles S in this zone is set to a ratio between 50% and 60%.

(3) Period for controlling the rotational speed R of the rotary ring member, correspond to the period of maintaining the common rotational speed of spindles S at $S_h$ a: The third constant speed zone (line $D_3$)

When the common rotational speed of spindles S reaches its maximum speed $S_h$ (30,000 rpm), while the rotational speed R of the rotary ring member reaches its maximum speed $R_h$ (18,000 rpm), the cop size becomes a percentage between 40% and 50% of a full packaged cop. Thereafter, the rotational speed R of the rotary ring member is controlled to maintain its maximum speed $R_h$ until the cop size is enlarged by 5% of the size of a full packaged cop.

b: First deceleration zone (line $K_5$)

Thereafter, the rotational speed R of the rotary ring member is controlled at a constant deceleration rate so as to slow down to reach the fifth constant step speed $R_5$ which is identical to the second step speed $R_2$ (12,000 rpm), until the cop size is increased by 5% of the size of a full packaged cop.

c: Fourth constant speed zone (line $D_4$)

Thereafter, the rotational speed R of the rotary ring member is controlled to maintain its speed R at the fifth step speed $R_5$ (12,000 rpm), until the cop size becomes a condition of closely before a time when the cop size is enlarged to a percentage between 80% and 90% of a full packaged cop. The ratio of the rotational speed $R_h$ of the rotary ring member to the common rotational speed of spindles $S_h$ is 40%. Under such a condition, the spinning operation is carried out in the most desirable, stable condition. This is one of the major advantages of the present embodiment.

d: Fifth acceleration zone (line $K_6$)

When the cop size becomes a percentage between 80% and 90% of the size of a full packaged cop, the rotational speed R of the rotary ring member is controlled to accelerate, at a constant rate, so as to return to its maximum speed $R_h$ (18,000 rpm) which is 60% of the maximum common rotational speed of spindles $S_h$ (30,000 rpm).

e: Fourth constant speed zone (line $D_5$)

Until the cop size reaches 95% of the size of a full packaged cop, the rotational speed R of the rotary ring member is controlled to maintain its speed at $R_h$ (18,000 rpm).

(4) Period for decelerating the rotational speed of the rotary ring member until the complete stop of the rotary ring member a: Second deceleration zone (line $K_7$)

Following the deceleration of the common rotational speed of spindles which is started at a time when 95% of the size of a full packaged cop is attained, the rotational speed R of the rotary ring member is controlled to decelerate at a constant rate so as to reach a seventh step speed $R_7$ which is a percentage between 30% and 40% of the seventh step speed $S_7$ of the common rotational speed of spindles S, until a time shortly before switching off the driving of the spindles. At this time point, an automatic device for stopping the driving of the spindles is actuated.

b: Sixth constant speed zone (line $D_5$)

During the period between the actuation of the above-mentioned automatic device and the switching off operation to stop the electric current supplied to drive the spindles, the rotational speed R of the rotary ring member is controlled to maintain the seventh step speed $R_7$.

c: The third deceleration zone (line $K_8$)

When the electric current supply is switched off, the rotational speed R of the rotary ring member is controlled to decelerate its rotational speed R at a rate which is larger than the deceleration rate of the common rotational speed of spindles S, so as to completely stop the rotary ring member at a time not later than the complete stopping of the spindles. The time period HR between the time needed to completely stop the rotation of the rotary ring member is designed to be between 5 and 9 seconds, if the time period HS between switching off and the complete stopping of the spindles is set to 10 seconds. Due to the design the program for stopping the rotation of the spindles and the rotary ring member as mentioned above, the formation of the top end portion and the tail end winding portion of the full packaged cop can be stably carried out, in addition to preventing the creation of snarls.

In the above-mentioned example of the control program, the rotational speed of the rotary ring member is controlled to slow down to the rotational speed $R_5$ (12,000 rpm) in the major portion of the period wherein the common rotational speed of spindles S is maintained at its maximum speed $S_h$ (30,000 rpm). It is also practical to control the rotational speed R of the rotary ring member in such a way that the rotational speed R is elevated to its maximum speed such as 16,000 rpm when the size of the cop becomes between 22% and 30% of the full packaged cop, and is maintained at its maximum speed until the cop size becomes 80% to 90% of the full packaged cop, while the rotational speed R of the rotary ring member is accelerated and decelerated by the respective control programs shown in FIG. 3 which are programmed with a principle similar to the above-mentioned program control of the rotational speed of the rotary ring member. This condition is shown by a dotted line in FIG. 3. In this case the ratio between the rotational speed of the rotary ring member to that of the common rotational speed of spindles is designed to be substantially identical to the first mentioned control program for controlling the rotational speed of the rotary ring member.

As already explained, the above-mentioned typical control program is designed so that the rotational speed of the rotary ring member should not be over the rotational speed of the traveller. Therefore, the ratio α between the rotational speed R of the rotary ring member and the common rotational speed of spindles S is selected conservatively to be a value between 40% and 60%.

The control program for controlling the rotational speed R of the rotary ring member is based on the cop size which can be measured by detecting the position of ring rail which moves upward due to the lifting motion of the ring rail in relation to the position of a lappet rail whereon respective snail wires (yarn guides) are mounted, from the starting time of driving the spindles to the time of switching off the driving of spindles, for forming full packaged cops. The above-mentioned position of the ring rail can be easily detected by applying a known detecting technique disclosed in the specification of U.S. Pat. No. 5,009,063, the disclosure of which is incorporated by reference (see in particular column 6, from line 27 to line 43), therefore, the explanation of means for detecting the position of the ring rail during the motion thereof is omitted. However, the control program can be designed to be based on the passing of time for forming a full packaged cop.

Next, the automatic method for controlling the rotational speed of the rotary ring member of the rotary ring device based upon the above-mentioned control program of the rotational speed R of the rotary ring member in relation to the control program of the common rotational speed of spindles S, shown by a block diagram in FIG. 1, which is applied to a ring spinning frame, is explained. In this case, the subject of the above-mentioned control method is, of course, a rotary ring device provided with a rotary ring member which can be electrically controlled in its rotational speed from outside.

BASIC METHOD FOR CONTROLLING THE ROTATIONAL SPEED OF THE ROTARY RING MEMBER (1) Setting of the ratio α between the rotational speed R of the rotary ring member and the common rotational speed of spindles S The ratio α between the rotational speed R and the common rotational speed of spindles S is predetermined in relation to the control program of the common rotational speed of spindles S which is determined so as to produce a full packaged cop by each rotary ring device so that the program of the ratio α is made for carrying out the control method applied to the ring spinning frame.

(2) Starting the rotation of the rotary ring member

As already explained, to form a stable tail end portion of a cop in each rotary ring device, the rotary ring member is electrically controlled to start its rotation at the end of a period $P_1$ (5 sec–10 sec), after the driving of the spindles is started.

(3) Control of the rotational speed of the rotary ring member a: The rotational speed R of each rotary ring member is continuously independently detected, while the common rotational speed of spindles S in the above-mentioned control system for controlling the common rotational speed of spindles S is utilized.

b: The desired rotational speed $R_j$ of the rotary ring member is continuously calculated based upon a formula $[R_j=S\times\alpha]$, where S is the common rotational speed of spindles, which is detected at the exact time of detecting the rotational speed R of the rotary ring member, and α is a predetermined ratio between the rotational speed R of the rotary ring member to the common rotational speed of spindles S in relation to the predetermined control program for controlling the rotational speed of the rotary ring member. The ratio α is predetermined to be below 90% to prevent a possible over-running of the rotary ring member over the rotation of a corresponding traveller which is running along the rotary ring member concerned.

c: The rotational speed R of the rotary ring member is compared with the calculated desired rotational speed $R_1$ of the rotary ring member, for each rotary ring device.

d: If it is detected that the result of the above-mentioned comparison $(R-R_j)$ exceeds an allowable condition such as an allowable range, the rotational speed R of the rotary ring member concerned is electrically controlled so as to return $(R-R_j)$ to a condition satisfying the allowable condition (for example, into an allowable range).

According to the above-mentioned basic control method, the rotational speed of the rotary ring member is always controlled so as not to go over the rotational speed of the traveller running on the rotary ring member concerned, and the rotary ring member is controlled to start its rotation at a time a few second after the starting time of driving the spindles, and to stop its rotation at a time not later than the time of the complete stopping of the rotation of the spindles.

In the above-mentioned automatic method for controlling the rotational speed of the rotary ring member of the rotary ring device, the ratio (α) of the rotational speed (R) of the rotary ring member to the common rotational speed of spindles S is determined in relation to the predetermined control program for controlling the common rotational speed of spindles S for the entire period of the full package cop forming process, under the condition that the yarn tension is always maintained in its allowable range. Accordingly, the control program of the above-mentioned ratio can be created as a result. However, it is a minor problem that the result of the automatic control action of the rotational speed of the rotary ring member, according to the above-mentioned program of the ratio (α), is not confirmed. To solve this problem, the following modification has been developed. That is, in the modification of the above-mentioned basic automatic control system, the control system is further provided with means for detecting yarn tensions 55A of plural rotary ring devices; means for calculating an average value of the detected yarn tensions, means for comparing the above-mentioned average yarn tension with the predetermined allowable range of the yarn tension; and actuating means for regulating the rotational speed of the rotary ring member, wherein when the comparing means detect that the average yarn tension is out of control, the average yarn tension is returned to the allowable range of yarn tension, even in a condition where the rotational speed of individual rotary ring members of the above-mentioned rotary ring devices are in the controlled condition in relation to the common rotational speed of spindles. As means for detecting the yarn tension, a yarn tension detecting device disclosed in U.S. Pat. No. 5,009,063, as indicated by reference numeral 52, can be effectively utilized. Using a well-known electrical circuit (an operational amplifier can be utilized) as a means for calculating an average value of detected yarn tensions, that is, a plurality of electrical signals simultaneously issued from respective devices such as the device disclosed in U.S. Pat. No. 5,009,063, are input into an operational amplifier which is disclosed in a Japanese reference book [Method for calculation in Electric Circuit] so that the sum of the inputs is output from the operational amplifier. Accordingly, the average value of the signals can be easily obtained.

In the above-mentioned modification, the basic idea additionally adopted in the control system is based upon the experimental knowledge that, when driving the spindles at a constant common rotational speed of spindles, if the rotational speed of the rotary ring member is elevated, the yarn tension is lowered, while the variation of the yarn tension becomes small. On the contrary, if the rotational speed of the rotary ring member is lowered, the yarn tension is elevated, while the variation thereof is also increased. On the other hand, if the common rotational speed of spindles is elevated, the variation of the yarn tension is also increased. On the contrary, if the common rotational speed of spindles is reduced, the yarn tension is also reduced, while the variation thereof is also reduced. However, it is essential to have quick response of the control action to regulate the yarn tension. From this point of view, the effect of inertia of the machine elements must be considered, therefore, in the above-mentioned modified control method and system, only the rotational speed of the rotary ring member is regulated. In this modified control method, when it is detected that the yarn tension is elevated over the upper allowable limit thereof, the rotational speed of the rotary ring members of the respective rotary ring devices are elevated so as to return the average yarn tension to below the allowable upper limit. On the contrary, when it is detected that the average yarn tension is lowered to a condition below the allowable lower limit of yarn tension, the rotational speed of the rotary ring members of the respective rotary ring devices are lowered so as to return to the condition above the lower allowable limit. As mentioned above, the additional control of the rotational speed of the rotary ring member is carried out even when the rotational speed of the rotary ring member is still in the controlled condition with relation to the common rotational speed of spindles.

In the automatic control method for controlling the rotational speed of the rotary ring member according to the present invention, a so-called Fuzzy Control system can be applied. That is, in the step of adjusting the rotational speed of the rotary ring member according to the result of the step of comparing the rotational speed R of the rotary ring member to the calculated desired rotational speed $R_j$ of the rotary ring member, the result of the above-mentioned comparison is estimated by using a fuzzy set, for example "optimum", "upper", "lower", defined by a membership function which is well known in the theory of fuzzy control systems, and the rotational speed R of the rotary ring member is adjusted by an electric signal relying upon the above fuzzy set, so as to maintain the allowable condition. For a discussion of Fuzzy control, see *Fuzzy Control and Fuzzy Systems*, by W. Pedrycz, Second, Extended, Edition, 1993, published by John Wiley and Sons, the disclosure of which is incorporated by reference.

As another modified method for controlling the rotational speed of the rotary ring member according to the present invention, the following modification can be applied in practice, if it is acceptable that the control result is a little coarse. That is, in this modification, the ratio $\alpha$ is set to a constant value 0.9 for the entire period of the full packaged cop forming process. The technical idea of this modification is based upon the fact that the rotational speed of the traveller is always lower than the common rotational speed of spindles and the difference between the rotational speed of the traveller is quite close to the common rotational speed of spindles. According to the common knowledge in textile engineering, if the ratio $\alpha$ is set as mentioned above, the undesirable condition that the rotational speed of the rotary ring member exceeds the rotational speed Rt of the traveller, can be prevented. Therefore, the above-mentioned modification can be interpreted as an automatic control method for coarsely controlling the rotational speed of the rotary ring member whereby the following relationship; $R \leqq R_t$ can be maintained.

Another modification of the above-mentioned basic automatic control method according to the present invention has also been developed. This modification can be effectively applied to the full packaged cop forming process characterized by very high speed common rotational speed of spindles, for example 50,000 rpm, or by the production of a full packaged cop having a very large size, for example, 3.0 times size of the normal full packaged cop.

In the case of the above-mentioned full packaged cop forming process, the rotational speed of the traveller at the time point corresponding to the largest diameters of the cop, is remarkably greater than the rotational speed of the traveller at the time point corresponding to the smallest diameter of the cop, in each unit process for creating each chase of the cop. Accordingly, even if the rotational speed of the rotary ring member is effectively controlled by the basic automatic control method of the present invention, it is effective to supplementarily control the rotational speed of the rotary ring member to eliminate the undesirable effect due to the above-mentioned difference of the traveller speeds during the unit process for creating each chase. The above-mentioned supplemental control of the rotational speed of the rotary ring member is carried out in consideration of the time delay for response of the machine elements related to the rotary ring device. Since the ring rail is displaced in the direction along the axial center of the spindles during the full packaged cop forming process, while a unit upward and downward displacing motion of the ring rail to create successive chases of the cop is repeated, the changing mode of the cop diameter during the full packaged cop forming process can be directly detected by the above-mentioned displacing motion of the ring rail in relation to the motion of the lappet rail. Accordingly, the program for supplementary controlling the rotational speed of the rotary ring member can be easily established by detecting the position of the ring rail. U.S. Pat. No. 5,009,063 (in the specification from column 5, line 52 to column 6, line 61) discloses in detail how to detect the position of the ring rail during the full packaged cop forming process, and accordingly, the technical idea for detecting the position of the ring rail disclosed in this prior art is preferably applied to create the supplemental control program of the rotational speed of the ring rail.

In this modification, the program for supplementary control of the rotational speed of the rotary ring member is made based upon the unit motion of the ring rail to form two chases of the cop, which overlap each other. In the program, the starting point of each unit program for the supplemental control of the rotational speed of the rotary ring member is started when a first point thereof which is a position of the ring rail, corresponds to the maximum diameter of the cop, and a middle point of the unit program is set at a position of the ring rail which corresponds to the maximum diameter of the cop, and the last point of the unit program is set at a position of the ring rail which corresponds to a returned position thereof adjacent to the starting position of the next unit program. Therefore, it can be understood that a first chase formation of the above-mentioned overlapped two chases is carried out by the process of displacing the ring rail from the position of the first point of the unit program to the position of the middle point of the unit program, while a second chase formation of the above-mentioned two overlapping chases is carried out by the process of displacing the ring rail from the position of the middle point of the unit program to the position of the last point of the unit program. Accordingly, the unit supplemental control program is made by the above-mentioned unit motion of the ring rail to create the two overlapping chases, in relation to the displacement of the position of the ring rail.

As it is well known in the art, the full packaged cop forming process is carried out by the motion of the ring rail wherein the ring rail is displaced from a starting position corresponding to the bottom portion of a bobbin, which is utilized for forming the full packaged cop, to an end position corresponding to the top portion of the bobbin, and while repeating the above-mentioned unit up and down motion, the supplemental program is made to cover the entire period of the full packaged cop forming process, which is formed by successive unit supplemental programs. And, the above-mentioned supplemental program is combined with the basic control program for controlling the rotational speed of the rotary ring member as the basic method for controlling the rotational speed of the rotary ring member of the present invention so that very effective result can be obtained.

Since the ring rail is displacing regularly with repeated unit up and down motion, the supplemental program is designed based upon the position of the ring rail, and the mode of the motion of the ring rail. For example, in the case of regularly repeating unit up and down motion, a supplemental ratio ($\beta$) which corrects the above-mentioned ratio ($\alpha$) defined in the above-mentioned basic control method for controlling rotational speed of the rotary ring member, is set to linearly increase or decrease between two positions of the ring rail. The first one of these two positions corresponds to the above-mentioned starting point of the unit program, while the other position corresponds to the above-mentioned middle point of the unit program, and between the two positions of the ring rail, the first one of these two positions corresponds to the above-mentioned middle point of the unit program, while the other position corresponds to the final point of the unit program. For example, in the case of carrying out each unit up and down motion of the ring rail at a constant speed, the supplemental ratio ($\beta$) which modifies the above-mentioned ratio ($\alpha$) (rotational speed of the rotary ring member/common rotational speed of spindles), is designed to realize a so-called linear mode, and accordingly, a unit zig zag mode program is made. Therefore, the supplemental program of (β) for the entire period for carrying out the full package forming process based upon the above-mentioned basic control method is created.

Next, a new control program for controlling the rotational speed of the rotary ring member is made by combining above-mentioned supplemental program of (β) with the basic control program of (α) in relation to the common rotational speed of spindles according to the present invention. That is, a modified ratio (α') (rotational speed of the rotary ring member/common rotational speed of spindles) is obtained by the following formula, $\alpha'=\alpha\times\beta$, wherein, α and β are ratio obtained at an identical time point. Accordingly, the control program based upon the modified ratio α', in relation to the common rotational speed of spindles, is made to cover the entire period of the full packaged cop forming process. Accordingly, the full packaged cop forming process can be carried out in a precisely controlled condition, by eliminating the undesirable effect on the spinning condition due to the distinct difference of rotational speed of the traveller.

The above-mentioned condition of modifying the variable ratio α can be easily understood from the attached drawings 8A, 8B and 8C, wherein A indicates a part of a predetermined program of the variable ratio α, B indicates a part of a program of ratio β for changing the above-mentioned predetermined program of the variable ratio α, C indicates a program of modified variable ratio α' created by the combination of the variable ratio α with the supplemental ratio β, t indicates a period of a unit lifting motion of a ring rail, $t_1$ indicates a period of elevating the ring rail, and $t_2$ indicates a period for lowering the ring rail during each unit lifting motion of the ring rail.

It is explained above that the ring rail is displaced while the spindle rail, whereon the spindles are arranged, takes a stationary position. In some textile machines, the full packaged cop forming operation is carried out by displacing the spindle rail while the ring rail is stopped at its stationary position. However, the identical technical idea also applies to the latter case.

The following modification of the above-mentioned basic control method of the present invention is also applicable, and the result of the control action is substantially the same in both methods. In this modified method, the detected spindle speed R of the rotary ring member is compared with the detected common rotational speed of spindles S so that a data (S-R) is obtained. Then data α' is calculated by a formula (S-R)/S, the calculated data α' is compared with the predetermined ratio α, and if it is detected that the calculated data α' is out of control regarding a predetermined allowable condition, the rotational speed of the rotary ring member, which is detected the out of controlled condition is electrically controlled to return the rotational speed thereof to a predetermined allowable condition.

ROTARY RING DEVICE IN WHICH THE PRESENT INVENTION IS PREFERABLY APPLIED

Figure 2:
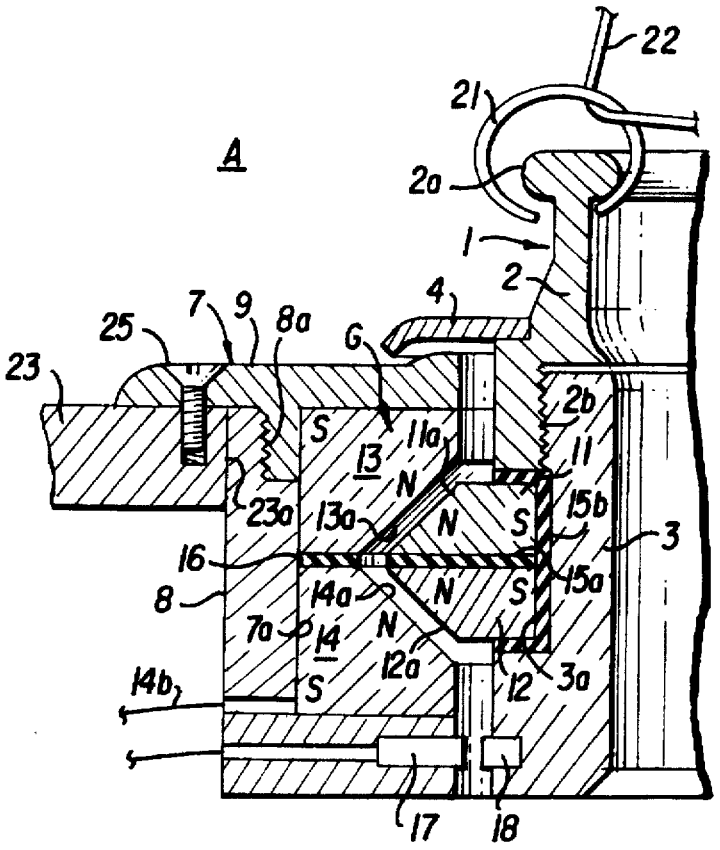
FIG. 2 is a partly sectional view of an example of the rotary ring device which is a subject of the present invention.

Next, the construction and function of a typical rotary ring device provided with a magnetic bearing, to which the present invention is preferably applied, is explained in detail, with reference to FIG. 2.

In the rotary spinning ring assembly A shown in FIG. 2, a rotary ring member 1 is constituted by a flange rotor 2 having an annular flange portion 2*a* on which a traveller 21 can be slidably displaced, and a lower rotor 3 is connected to the flange rotor 2 by screws 2*b*. The lower rotor 3 is made of a non-magnetic metal material such as an aluminum alloy having magnetic resistance, a copper alloy, a stainless steel, a carbon group material or the like, and an electrically conductive synthetic material or the like, and thus leakage of magnetic flux is reduced to a minimum value.

The ring rotary member 1 is rotatably supported in a holder 7 by a bearing mechanism G, and the holder 7 is inserted into an attaching hole 23*a* of a ring rail 23 and fixed by a screw 25.

The bearing mechanism is constituted as follows. Two annular permanent magnets 11 and 12 are fixed through spacers 15*a* and 15*b* into a concave groove 3*a* formed in the lower rotor 3 of the rotary ring member 1. The outer circumference in a radial direction of each of the permanent magnets 11 and 12 has a tapered face 11*a* and 12*a* having an angle of around 45° relative to the axis thereof, and the magnetic pole of the tapered face 11*a* and 12*a* is a N-pole.

The spacer 15*b* is used as a magnetic sealing means so that a leakage of magnetic flux of the permanent magnets 11 and 12 to the outside, in particular the ring flange portion 2*a* and the traveller 21, is prevented. The holder 7 is constituted by a holder main body 8 and a cover 9 connected thereto by a screw 8*a* or the like.

An annular permanent magnet 13 and an annular electromagnet 14 are fixed through a spacer 16 into a concave portion 7*a* formed in the holder 7. Tapered faces 13*a* and 14*a* having an angle of 45° relative to the axis of the rotary ring member are formed on the inside circumference in a radial direction of the permanent magnet 13 and the electromagnet 14, in such a manner that both tapered faces form a groove having a substantial v shape, and the tapered faces 13*a* and 14*a* and the tapered faces 11*a* and 12*a* are arranged in an opposing relationship with a suitable gap therebetween.

The magnetic pole of the tapered face 13*a* is the same as the magnetic pole of the tapered face 11*a*, i.e., a N-pole, and the magnetic pole of the tapered face 14*a* of the electromagnet 14 is made an N-pole by supplying an electric current in a normal direction, to a lead line 14*b* of the electromagnet 14. The intensity of the electromagnet 14 can be adjusted by adjusting the electric current.

It is possible to use electromagnets having various structures, having a structure in which a plurality of pillar-like electromagnets constituted by winding a coil on a pillar-like core having a circular section or a fan-like section are arranged in a concave portion 7*a* of the holder 7 along a circumferential direction thereof, in a state such that a magnetic pole of the pillar-like electromagnet is fixed to an annular plate having magnetic properties, and an electromagnet having a structure in which a coil is wound on an iron core having the shape of a circular pillar is then accommodated in the concave portion 7*a* or the like.

The electromagnets 11, 12 and 13 are isotropic magnets of a metal, a ferrite (an oxidate ceramic), a rare earth element, a rubber, a plastic or the like. Further, if necessary, opposite faces of the permanent magnets 11, 12 and 13 and the electromagnet 14 are provided with a cover such as a sheet, a film or a coating layer, to protect the pole surface. This cover may be made of a non-lubricated sliding material having a lower friction coefficient, a superior resistance to abrasion and a superior resistance to heat, e.g., a ceramic, a tetrafluoroethylene including a filler such as a carbon fiber or the like, or a high polymer engineering plastic such as a polyimide, a polyamide-imide or the like.

A spacer 16 is made of an electrical insulating material such as mica, a high polymer resin, a ceramic or the like, to electrically insulate the electromagnet 14 from the permanent magnet 13.

A sensor 17 is attached to a holder body 8, and a detecting member 18 for generating a pulse, i.e., a detecting signal, to be supplied to the sensor 17, is arranged on an outer circumferential face of a lower rotor 3. Accordingly, by providing light and dark portions or notches, the rotational number, i.e., the rotational speed, can be detected by counting the detection signals from the sensor 17. The numeral 4 denotes a dust cover, and 22 a yarn supplied from a snarl wire in a ballooning state and wound on a cop (not shown).

In this rotary ring member A, a magnetic pole having substantially the same intensity as that of a tapered face 13*a* of the permanent magnet 13 is formed on a tapered face 14*a* of the electromagnet 14, by supplying a suitable electric current through a lead line 14*b* to the electromagnet 14, and thus the permanent magnets 11 and 12 are floated from the permanent magnet 13 and the electromagnet 14, because the tapered faces 11*a* and, 12*a* repel against the tapered faces 13*a* and 14*a*, respectively.

Accordingly, the rotary ring member 1 can be rotated at an extremely small rotational speed and an energy loss caused by friction or the like becomes extremely small, and thus the rotary ring member can be rotated at a high rotational speed by a torque applied from a traveller 21.

When the electric current supplied to the electromagnet 14 is reduced, the magnetic force of the electromagnet is lowered so that a component of the above-mentioned magnetic force directed upwards is lowered, that is, the pressing force of the electric magnet 14 applied upwards against the permanent magnets 11 and 12 is lowered, accordingly, and the ring rotary member 1 moves downward and the tapered face 12*a* comes into contact with the tapered face 14*a* by a repelling force between the tapered face 11*a* of the permanent magnet 11 and the tapered face 13*a* of the permanent magnet 13 and the ring rotary member's own weight. This contact pressure can be controlled by varying the intensity of the electric current supplied to the electromagnet 14.

When the direction of the electric current is reversed, the magnetic pole of the tapered face 14*a* of the electromagnet 14 becomes a S-pole, and a strong braking force is generated because the S-pole of the tapered face 14*a* and the tapered face 12*a* of the permanent magnet 12 are attracted to each other.

Accordingly, the braking force can be controlled by controlling the amperage and the direction of the electric current supplied to the electromagnet 14, and thus the rotational speed of the ring rotary member and a time required to stop the ring rotary member when rotating at a high rotational speed can be controlled.

The other rotary ring devices provided with a magnetic bearing, to which the present invention can be applied, are hereinafter explained briefly, with reference to FIGS. 5 and 6, because each element having identical function to that of the first embodiment of the rotary ring device shown in FIG. 2 is represented by an identical reference numeral.

Figure 5:
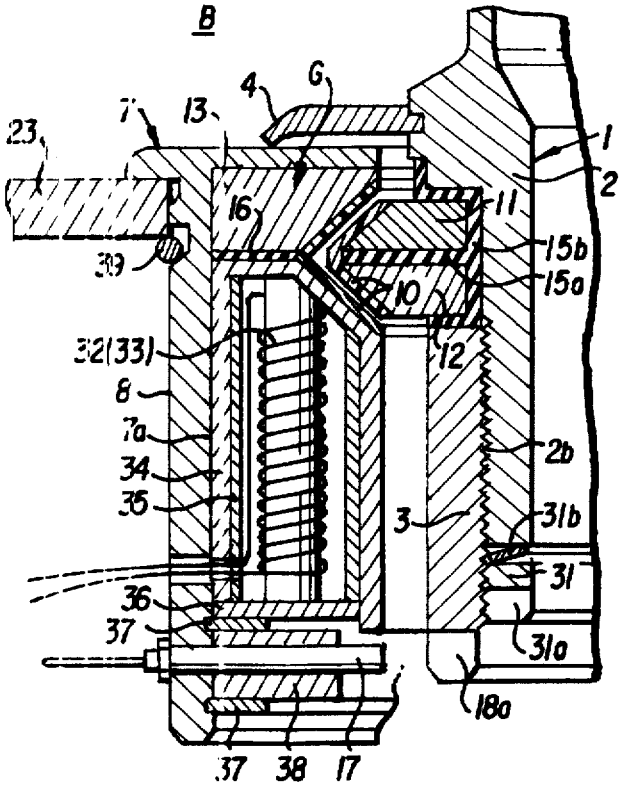
FIGS. 5 and 6 are partly sectional views of the other rotary ring devices which are subject to the automatic control system according to the present invention.
Figure 6:
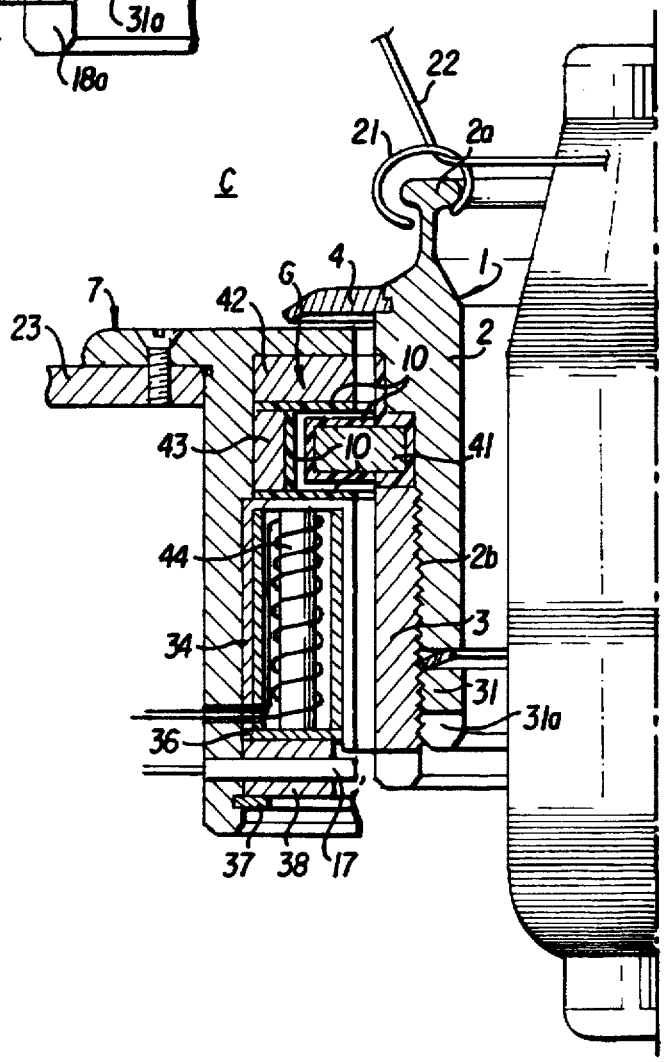

In a rotary ring member 1 shown in FIG. 5, a flange rotor 2 and a lower rotor 3 are connected by a thread 2*b* and are fixed through a belleville spring 31*b* by a locknut 31 having a tool engaging groove. A notch 18*a* is provided in a lower end of the lower rotor 3 and a sensor 17 detects the notch 18*a* and generates a signal denoting a rotational number.

A holder 7 is attached with a yoke case 34, a plurality of equally spaced holes are arranged in a circumferential direction in the yoke case 34, and a wave guide 35 is accommodated in each hole. Electromagnets 32 and 33 having a cross section with a circular shape or a fan-like shape, and on which a coil is wound, are accommodated in the wave guide. The lead lines extend from the electromagnets 32 and 33. The numeral 4 denotes a cover, 36 a bottom plate, 37 an end ring, 38 a stop ring, and 39 a spring used for fixing the ring.

It is possible to greatly increase the intensity of the magnetic force of the electromagnets 32 and 33 in the rotary spinning ring device B, whereby the operation of a bearing mechanism G is stabilized, and thus it is possible to effect a strong braking force by controlling an electric current supplied to the electromagnets 32 and 33.

A constitution wherein the permanent magnets 11, 12 and 13, and electromagnets 32 and 33 include a tapered face, respectively, is used in the above examples, but it is possible to adopt a constitution not having the tapered face. For example, in a rotary spinning ring device C shown in FIG. 6, a permanent magnet 41 adhered to the ring rotary member 1 is formed as an annular plate having a rectangular cross section, and permanent magnets 42 and 43, and an electromagnet 44 may be arranged in such a manner that a part of an upper side and a lower side, and a side between the upper side and the lower side, form a letter C type cross section.

Figure 7:
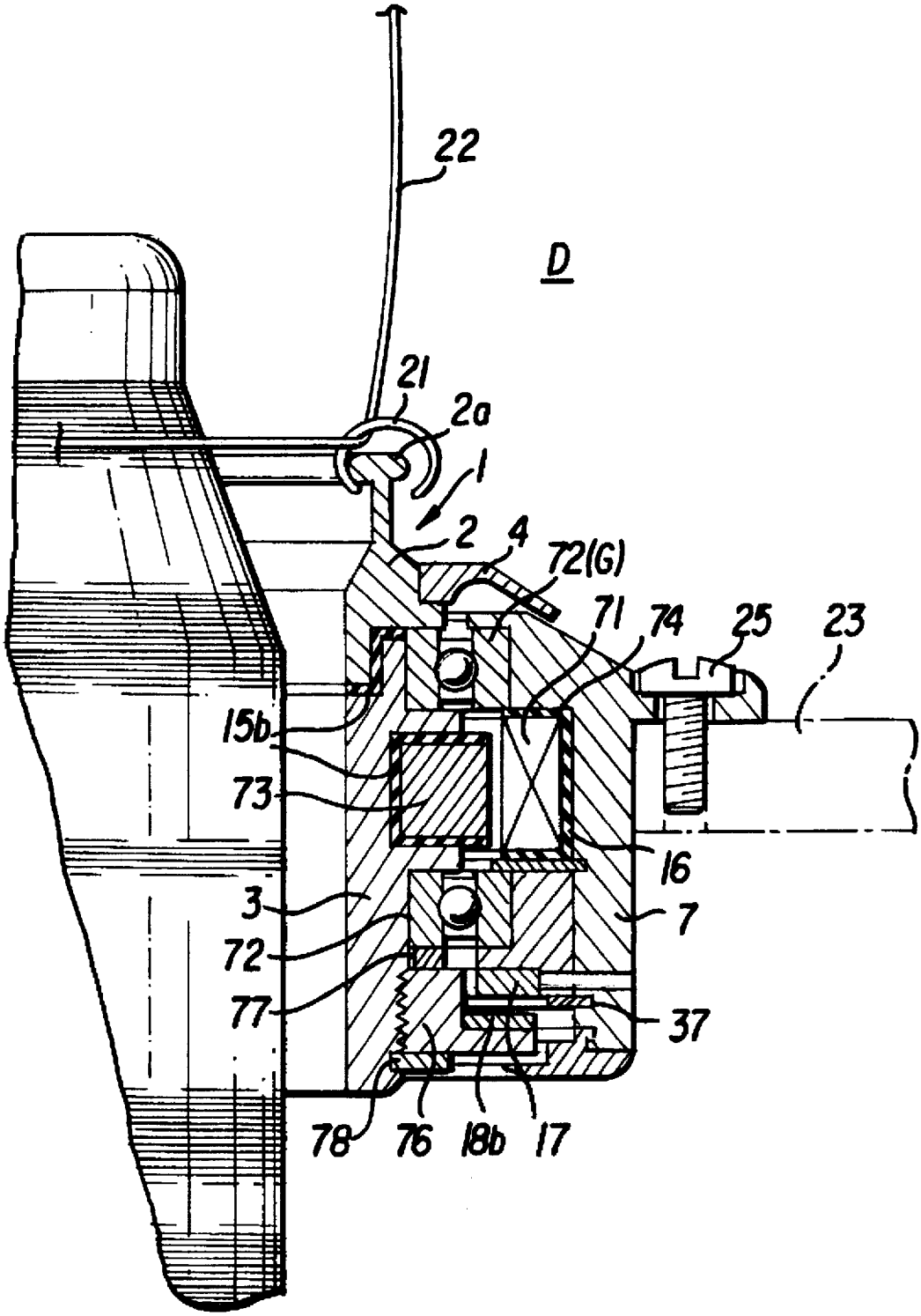
FIG. 7 is a partly sectional view of the rotary ring device provided with a ring motor, to which the basic technical idea of the present invention can be effectively applied.
Figure 8A:
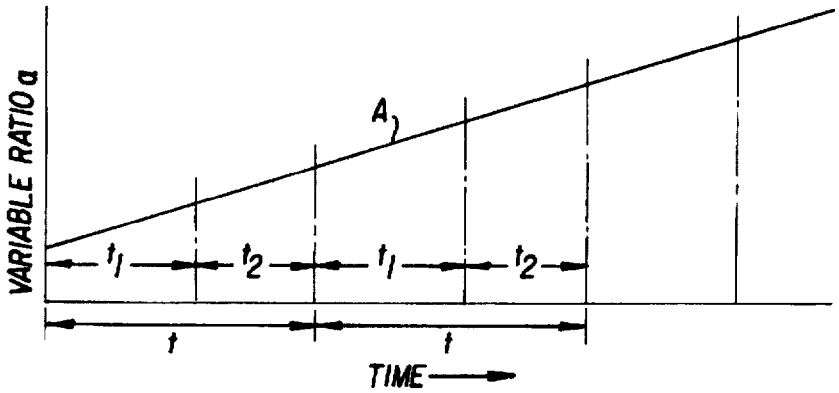
FIGS. 8A, 8B and 8C are drawings for explaining an example of a supplemental program for changing a variable ratio $\alpha$ in relation to a unit lifting motion of a ring rail of a textile machine provided with rotary ring devices.
Figure 8B:
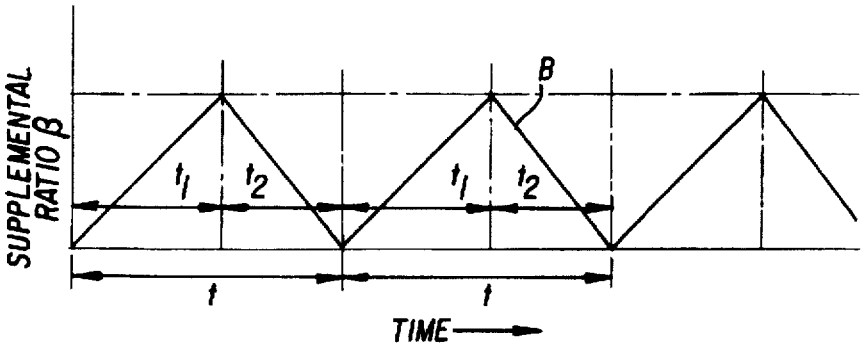
Figure 8C:
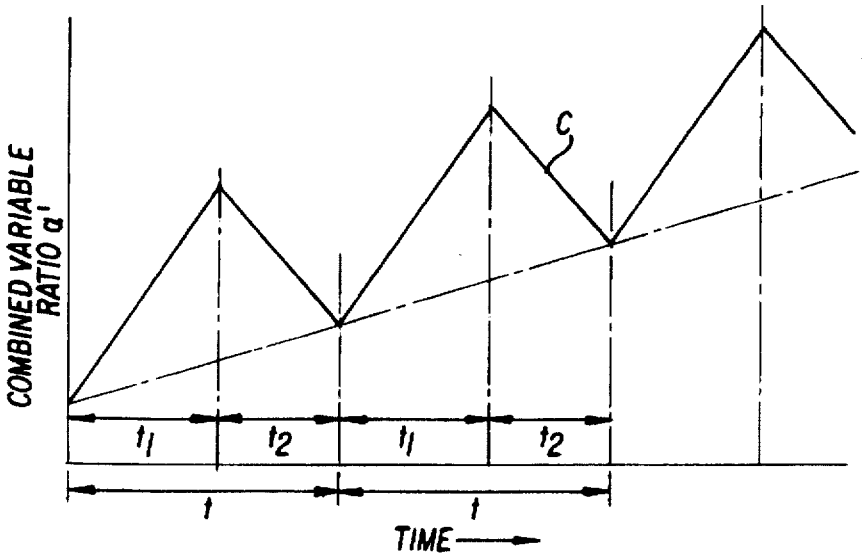

The rotary ring device provided with a ring motor, to which the basic technical idea of the present invention can be applied, that is, hereinafter explained with reference to FIG. 7, wherein each element having an identical function to that of the first embodiment of the rotary ring member shown in FIG. 2 is also represented by an identical reference numeral.

In this rotary ring spinning ring device D, a ring rotary member 1 is rotatably supported through a bearing 72 in a holder 7, a motor 71 comprised of a permanent magnet rotator 73 arranged on a substantially center portion in an axial direction in an outer circumferential portion of the ring rotary member 1, and an armature 74 arranged on a substantially center portion in an axial direction and in an inner circumferential portion of the holder 7, so that the rotator 73 and the armature 74 are opposite each other. This motor 71 directly drives the ring rotary member 1 and the rotational speed of the ring rotary member 1 can be changed by adjusting a frequency or an amperage of the electric current supplied to the motor 71. The numeral 18*b* denotes a detecting plate having a white portion and a black portion used for detecting a rotational speed thereof by a reflection type sensor 17; 76 is a rebound spring, 77 a spacer, and 78 a stop ring.

When using this rotary spinning ring device D, it is possible to control the device D by adjusting a frequency or an amperage of the electric current supplied to the motor 71 by the braking and controlling circuit 55 (FIG. 1), and to make the rotational number R of the ring rotary member 1 coincide with the desired rotational number $R_j$.

In the above-mentioned rotary ring devices, it is possible to use a type of rotary ring member formed by a flange rotor 2 and a bottom rotor 3, which are united as one body by pressing one member into another. Shape, dimension, structure, materials, a number of elements used, and arrangement of the elements, are optionally determined in accordance with the present invention.

AUTOMATIC CONTROL SYSTEM FOR CONTROLLING ROTATIONAL SPEED OF THE ROTARY RING MEMBER

The composition and function of the automatic control system for controlling the rotational speed of the rotary ring member (hereinafter simply referred to as an automatic control system of the present invention) is explained below with reference to FIGS. 1 and 4.

As already explained, the automatic control system of the present invention cooperates with the automatic control system for controlling the common rotational speed of spindles. That is, means for detecting the rotational speed of the spindles and means for calculating an average value of the detected rotational speed of the spindles, which is referred to as the common rotational speed of spindles S, of the above-mentioned system are utilized for the automatic control system of the present invention. On the other hand, as means for detecting the rotational speed of the rotary ring member, means for detecting the rotational speed R of each rotary ring member shown in FIG. 2 is utilized as a typical example. A central control device mounted on the textile machine, such as a ring spinning frame, to which the above-mentioned control system is applied, comprises means for storing the above-mentioned ratio α set in relation to the program for controlling the common rotational speed of spindles S, means for calculating the desired rotational speed $R_j$ of the rotary ring member of respective rotary ring devices, means for comparing the detected rotational speed R to the desired rotational speed $R_j$ with respect to each rotary ring device, and means for electrically controlling other means for regulating the rotational speed R of the respective rotary ring devices.

In the control system for carrying out the method for controlling the rotational speed of the rotary ring member by the supplemental control program, as mentioned above, the composition of the control system is additionally provided with means for detecting the position of the ring rail during each formation of unit chase, whereby the desired rotational speed of the rotary ring member is calculated precisely by the modified ratio α', in relation to the detected data of the above-mentioned detecting means. Means for detecting the position of a ring rail as disclosed in U.S. Pat. No. 5,009,063 is effectively utilized for this system.

Next the above-mentioned automatic control system applied to a rotary ring device utilizing a magnetic bearing, utilized for a ring spinning frame, is explained with reference to FIG. 1.

As shown in FIG. 1, a program storing means 58 comprises a RAM or ROM wherein the ratio α and related programs for all of the spinning process, as determined for each type and yarn count of the various yarns to be spun, are stored.

This spinning program includes an optimum range of spinning tension for each spun yarn and data of the ratio α between the rotary ring member 1 of the rotary ring devices and a standard common rotational speed of spindles are determined based on a size ratio of a cop and by a stretch length, from a starting time to a time at which a full packaged cop is formed.

It is possible to load the spinning program into the storing means 58 from an outside storing means.

The standard common rotational speed of spindles can be controlled on the basis of the size ratio by detecting and inputting a position of the ring rail on a linear scale or by bringing the ring rail into sequential contact with microswitches rigidly mounted on a machine frame of the spinning frame.

As already explained, the detected rotational speed R of the rotary ring member is compared with the calculated speed $R_j$ which is obtained from the common rotational speed of spindles S based upon the detection, and the above-mentioned ratio α at an identical time point, since the ratio α is set in relation to the control program of the common rotational speed of spindles, and this ratio is stored in the program store means 58. Therefore, the common rotational speed of spindles S is also continuously controlled in such a way that, if it is detected that the common rotational speed of spindles S based upon detection exceeds an allowable limit in the comparison with the common rotational speed of spindles based upon the control program, the rotational speed of the spindle drive motor 51 is controlled by means 50 for controlling the common rotational speed of spindles.

A spindle drive main shaft 52 is rotated by the spindle drive motor 51 and each spindle 53 is driven through a belt or the like by the spindle drive main shaft 52. The spindle drive main shaft is provided with a rotation speed detector 59, such as a tachogenerator, a rotary pulse generator or the like, and the common rotational speed of spindles S is calculated by the processing circuit 60 based upon the rotational speed of the spindles detected by the detector 59, and the desired rotational speed $R_j$ of the rotary ring member is calculated by the calculation means 57 whereby the desired rotational speed $R_j$ is multiplied by the above-mentioned ratio α output from the storing means 58.

A rotation speed detecting circuit 54 detects the rotational speed R of the rotary ring member 1 by counting pulses output by the sensor 17. A comparing means 56 compares the rotational speed R detected by the detecting circuit 54 with the desired rotational speed $R_j$ of the rotary ring member issued from the calculation means 57, and the comparing means 56 issues output signals γ determined on the basis of the difference obtained by the comparison.

A braking and driving circuit 55 adjusts an amperage and/or direction of the electric current supplied to the electromagnet 14, on the basis of the output signal γ output from the comparing means 56, so that the braking force is created in the bearing mechanism G, whereby the rotational speed R of the rotary ring member 1 is controlled in relation to the desired rotational speed $R_j$ as already explained. That is, in the above-mentioned control of the rotational speed of the rotary ring member, the rotational speed R of the rotary ring member is controlled so that reach the signal γ becomes zero, or the signal γ returns to a predetermined allowable range as soon as possible.

The above-mentioned circuit and means are realized by hardware or a microprocessor including a suitable program.

Figure 4:
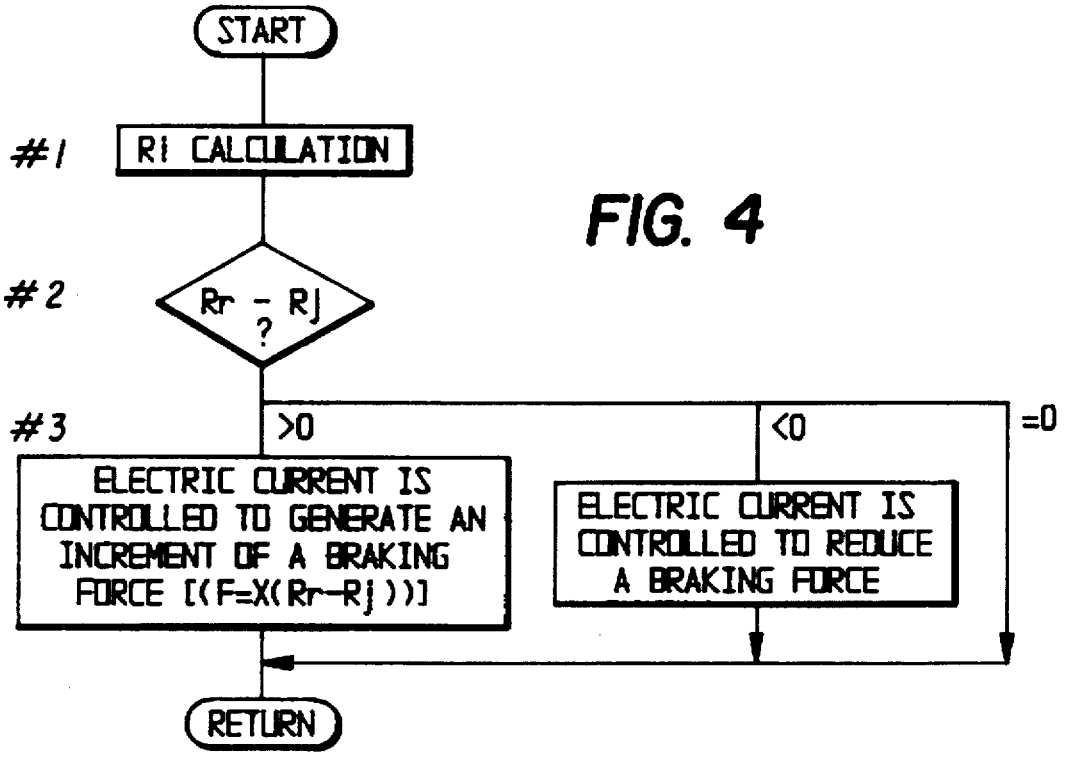
FIG. 4 is a flow chart indicating the operation of the comparing means and control circuit applied to the automatic control system according to the present invention.

Next, in the case of a rotary ring device utilizing a magnetic bearing, the function of the above-mentioned comparing means 56, the brake and driving circuit 55, is explained, with reference to the flow chart shown in FIG. 4. When the desired rotational speed $R_j$ of the rotary ring member is calculated by the calculating means 57 (First step #1), the detected rotational speed R of the rotary ring member is compared with the desired rotational speed $R_j$ of the rotary ring member by the comparing means 56 (Second step #2).

In the above-mentioned comparison, if it is detected that γ exceeds the above-mentioned allowable range on the positive side, that is, $R>R_j$, the braking and driving circuit 55 controls the rotational speed of the rotary ring member so as to increase the braking force of the bearing by adjusting the electric current supplied to the electric magnet 14, based upon the above-mentioned signal γ, whereby γ is returned to the allowable range. On the other hand, if it is detected that γ exceeds the allowable range on the negative side, that is, $R>R_j$, the braking and driving circuit 55 controls the rotational speed of the rotary ring member so as to decrease the braking force of the bearing by adjusting the electric current supplied to the electric magnet 14, based upon the above-mentioned signal γ, whereby γ is returned to the allowable range. And, if it is detected that γ is in the allowable range, the braking and driving circuit 55 does not change the electric current supplied to the electric magnet 14. (Third step #3)

When the cop size ratio becomes 1, i.e., the cop reaches a full packaged condition, a command indicating a rotational speed of 0 is applied to a spindle drive motor 51 or a supply of electric power is switched off and the electric current supplied to the electromagnet 14 is controlled by the braking and controlling circuit 55. For example, the direction of the electric current is changed to generate an attracting force between the permanent magnet 12 and the electromagnet 14 and suddenly increase the braking force of the bearing mechanism, and thus the rotation of the ring rotary member is controlled in such a manner that the ring rotary member is stopped at the same time or before the spindle is stopped.

On the other hand, in the case of applying the present invention to a rotary ring device utilizing a ring motor, the control system thereof is substantially identical to the above-mentioned control system applied to a rotary ring device utilizing the magnetic bearing. Accordingly, a detailed explanation of the control system applied thereto is omitted. However, it is a characteristic feature of this invention, that the rotational speed of the rotary ring member is controlled by adjusting the electric current, for example, adjusting AC frequency or amplitude of electric current applied, supplied to the armature 74 of the ring motor 1, so as to return the rotational speed R of the ring motor, in relation to the desired rotational speed $R_j$, to the allowable range.

As disclosed in the above-mentioned explanation of the present invention, in each case of the rotary ring device utilizing the magnetic bearing, or the ring motor, which are applied to a ring spinning frame, the rotational speed of the rotary ring member 1 and the spindles 53 are basically controlled, in relation to the control program of the common rotational speed of spindles such as shown in FIG. 3. Accordingly, the problem of an undesirable spinning condition, such as an unallowable variation in the spinning tension which is frequently observed if the spindles are driven at a very high rotational speed, creation of snarls which are created by over-running of the rotary ring member at the time of completion of the spinning operation to form full packaged cops, can be effectively prevented by applying the present invention for controlling the rotational speed of the rotary ring member. It is further recognized that, in the case of utilizing the magnetic bearing for the rotary ring member, for example the rotary ring device shown in FIG. 2, a centripetal force is generated by applying tapered faces 11*a* to 14*a* having an angle inclined to a rotation axis of the rotary ring member 1, and thus a possible waving rotation in a horizontal plane thereof can be prevented, whereby very stable rotation can be maintained.

Regarding the program storing means 58, as already explained, the control program may be loaded from a suitable outside storing means, or from a keyboard, or digital switch, and another type of control circuit having an identical function to the above-mentioned control circuit can also be applied.

INDUSTRIAL APPLICABILITY

According to the present invention, in the case of applying the present invention to a ring spinning frame provided with a rotary ring member, it is possible for the rotational speed of the rotary ring member to be controlled in relation to the control program based upon the predetermined ratio between the rotational speed of the rotary ring member and the common rotational speed of spindles, which is controlled by its control program predetermined so as to maintain the preferable spinning condition. The spinning operation is carried out under this preferable spinning condition. Moreover, the ratio of the rotational speed of the rotary ring member to the common rotational speed of spindles is particularly designed at the time of starting the driving of the spindles and also at the time of stopping the rotational speed of the spindles for forming the full packaged cop, so as to prevent creation of snarls, or the possible over-running of the rotary ring member against the traveller which is running the rotary ring member concerned. Accordingly, the spinning operation can be carried out in a stable condition, so that the time of driving the spindles at their highest common rotational speed of spindles can be elongated in compared with the traditional rotary ring device, and therefore, the present invention contributes greatly to production efficiency.

Beside the above-mentioned advantages in the case of applying the present invention to the rotary ring device utilized for the ring spinning frame, the present invention can be applied to textile machines utilizing a rotary ring device which is provided with electrical control for controlling the rotational speed of the rotary ring member of each rotary ring device separately, and accordingly the variation in the processing conditions in the plurality of the rotary ring devices can be positively controlled to a restricted value, so that the quality of products can be greatly improved.

It is a further advantage of the present invention that the automatic control method and system for controlling the rotational speed of the rotary ring member is capable of being applied to all textile machines utilizing the ring-traveller twisting and winding device, such as a ring spinning frame, ring twisting machine, draw twister, and cover yarn producing machine.

We claim:

1. A method for automatically controlling motion of a plurality of rotary ring devices in a textile machine during a period for producing a plurality of full packaged cops, said textile machine having a plurality of spindles and a mechanism for controlling a common rotational speed of said spindles according to a predetermined program by which said common rotational speed is forced to change during said period, said plurality of rotary ring devices being arranged along an alignment of spindles in cooperation with respective ones of said spindles, individual ones of said rotary ring devices having a rotary ring member capable of coaxially rotating with a corresponding spindle, a magnetic bearing rotatably supporting said rotary ring member, a traveller capable of running on a circular running trace formed by said rotary ring member, and means for electrically controlling braking action of said magnetic bearing so that a rotational speed of said rotary ring member is controlled, comprising (a) initially setting a control program of a variable ratio between a standard rotational speed of rotary ring members of a group of rotary ring devices and said common rotational speed of said spindles, in a condition that the rotational speed of respective ones of said rotary ring members does not exceed a rotational speed of said traveller, (b) continuously detecting said common rotational speed of said spindles and the rotational speed of each one of said rotary ring members of said group of rotary ring devices, (c) computing a desired rotational speed for said respective ones of said rotary ring members by multiplying said variable ratio by said detected common rotational speed of said spindles, where said ratio is defined as an exact time when the rotational speed of the respective ones of said rotary ring members is detected, (d) comparing said detected rotational speed of the respective ones of said rotary ring members with said desired rotational speed of said rotary ring members of said group of rotary ring devices, (e) electrically adjusting braking action of said magnetic bearing of said rotary ring members of said group of rotary ring devices when said comparison indicates that the rotational speed of said rotary ring member of said rotary ring device is outside a predetermined acceptable range of control whereby said rotational speed of said rotary ring member is controlled to satisfy said predetermined acceptable range of control.

2. Method for automatically controlling the motion of a rotary ring device according to claim 1, further comprising continuously detecting a yarn tension regarding each one of said rotary ring devices of said group as a measure for judging an operation condition of said textile machine, automatically calculating an average yarn tension based upon detected yarn tensions regarding said group of rotary ring devices, electrically controlling said braking action of said magnetic bearings of said rotary ring devices of said group until said average yarn tension returns into a predetermined allowable range independently from said control of the rotational speed of said rotary ring member based upon said predetermined program for changing said common rotational speed of said spindles, said predetermined program from changing said common rotational speed of said spindles being made based upon said allowable range of said average yarn tension.

3. Method for automatically controlling the motion of a rotary ring device according to claim 1, further comprising providing a supplemental program to change said variable ratio based upon said predetermined program of said variable ratio in relation to a yarn diameter of said cop during said period for producing a plurality of full packaged cops, said predetermined program for changing said variable ratio being modified by combining said supplemental program with said predetermined program.

4. Method for automatically controlling the motion of a rotary ring device according to claim 1, wherein said program for controlling said variable ratio involves zero points which define times for starting and stopping rotation of said rotary ring members.

5. Method for automatically controlling the motion of a rotary ring device according to claim 4, wherein said time for starting rotation of said rotary ring member is set to be delayed at least after the start of driving of said spindles, while said time for stopping rotation of said rotary ring member is set to be at least before the stopping of said spindle rotation.

6. Method for automatically controlling the motion of a rotary ring device according to claim 1, wherein said variable ratio is set at a value not to exceed 90%.

7. Method for automatically controlling the motion of a rotary ring device according to claim 1, wherein said program for controlling said variable ratio is established in a condition, in a period until said common rotational speed of spindles is elevated from zero to the maximum speed thereof, except for an initial period up to a time of starting rotation of said rotary ring member, said rotational speed of said rotary ring member is controlled to a slower speed than said common rotational speed of spindles with its speed increasing at a rate less than an increasing rate of said common rotational speed of spindles, in a period in which, after said common rotational speed of spindles reaches its maximum speed, operation of said textile machine is being carried out stably, in a condition that said common rotational speed of spindles reaches the maximum speed thereof, the rotational speed of said rotary ring member is reduced until said yarn tension returns into a predetermined allowable range thereof, in a period in which operation of said textile machine is being carried out unstably resulting in frequent yarn breakages, at a time before reducing common rotational speed of spindles from its maximum speed, the rotational speed of said rotary ring member is elevated to a predetermined rotational speed thereof and maintained at said predetermined rotational speed thereof and is then reduced at a rate not less than the reducing rate of said common rotational speed of spindles when said common rotational speed of spindles is reduced to stop the rotation of said spindles, whereby rotation of said rotary ring member is stopped not later than a time of stopping rotation of said spindles.

8. A system for automatically controlling motion of a plurality of rotary ring devices in a textile machine, said textile machine having a plurality of spindles and a variable rotational speed control mechanism mounted thereon, at least one ring rail arranged along an alignment of said spindles, said plurality of rotary ring devices being arranged on said ring rail along an alignment of said spindles in cooperation with respective ones of said spindles, individual ones of said rotary ring devices having (i) a holder rigidly mounted on said ring rail in coaxial condition to a corresponding spindle, (ii) a rotary ring member rotatably mounted on said holder in coaxial condition by way of a bearing, (iii) a traveller capable of running on a circular running trace formed by said rotary ring member, and (iv) means for electrically controlling rotational speed of said rotary ring member, said system comprising:

memory for storing a variable ratio $\alpha$ between a rotational speed of said rotary ring member and a common rotational speed of spindles, means for continuously detecting a common rotational speed of spindles S, means for continuously detecting a rotational speed R of said rotary ring member of each rotary ring device separately, means for calculating a desired rotational speed $R_j$ by multiplying said variable ratio $\alpha$ by said detected common rotational speed of spindles S, means for comparing said desired rotational speed R of said rotary ring member detected by said detecting means, with said desired rotational speed $R_j$ calculated by said calculation means at an identical time when said rotational speeds of said rotary ring member, and said common rotational speed of said spindles are detected, means for electrically controlling said rotational speed of said rotary ring member of a particular rotary ring device wherein an output signal of said comparision means detects a condition in which said detected rotational speed R does not satisfy an allowable condition defined based upon said desired rotational speed $R_j$ of said rotary ring member, whereby said rotational speed of said rotary ring member of said particular rotary ring device is returned to said allowable condition.

9. System for automatically controlling the motion of a rotary ring device according to claim 8, wherein said textile machine is provided with a predetermined program for controlling said common rotational speed of spindles over an entire period of carrying out a full packaged cop forming process in relation to controlling said rotational speed of said rotary ring member, said variable ratio $\alpha$ being selected in relation to said predetermined program for controlling said common rotational speed of spindles, whereby a control program for said variable ratio $\alpha$ is created in direct relation to said control program for controlling said common rotational speed of spindles.

10. System for automatically controlling the motion of a rotary ring device according to claim 9, wherein said bearing of said rotary ring device is a magnetic bearing, said magnetic bearing comprises an annular permanent magnet mounted on said rotary ring member, and an annular body rigidly mounted on said holder and provided with plural electric magnets, with said annular permanent magnet facing said annular body mounted on said holder, said electric magnet functions as said means for electrically controlling said rotational speed of said rotary ring member, whereby a minute annular space is maintained between said annular permanent magnet and said annular body provided with said electric magnets while a magnetic balance between said annular permanent magnet and said annular body in relation to said yarn tension and a weight of said rotary ring member is maintained, said rotary ring member remaining free to rotate, and when said magnetic balance is broken, said annular permanent magnet is brought into contact with said annular body of said rotary ring member so that a braking force against said free rotation of said rotary ring member is created, motion of said rotary ring member being controlled by controlling electric current applied to said electric magnets whereby said rotational speed of said rotary ring member is controlled, while said braking force is eliminated to allow free rotation of said rotary ring member, and rotation of said rotary ring member is forced to stop by bringing said permanent annular magnet into positive contact with said annular holder.

11. System for automatically controlling the motion of a rotary ring device according to claim 8, wherein said memory, said calculating means, said comparing means and said electrical control means are assembled as a central control device.

12. System for automatically controlling the motion of a rotary ring device according to claim 8, further comprising means for continuously detecting yarn tension as a measure for judging an operating condition of said textile machine, means for comparing detected yarn tension to a predetermined allowable range of said yarn tension, said comparing means for comparing said yarn tension being electrically connected to said means for electrically controlling said rotational speed of said rotary ring members in relation to said means for detecting said yarn tension, whereby when it is detected that said yarn tension is out of said allowable range, rotational speeds of said rotary ring members are changed until said yarn tension returns into said allowable range, instead of changing said common rotational speed of spindles.

* * * * *